US010465506B2

(12) United States Patent
Barbely

(10) Patent No.: US 10,465,506 B2
(45) Date of Patent: Nov. 5, 2019

(54) MUD-PULSE TELEMETRY SYSTEM INCLUDING A PULSER FOR TRANSMITTING INFORMATION ALONG A DRILL STRING

(71) Applicant: APS Technology, Inc., Wallingford, CT (US)

(72) Inventor: Jason R. Barbely, East Islip, NY (US)

(73) Assignee: APS Technology, Inc., Wallingford, CT (US)

( * ) Notice: Subject to any disclaimer, the term of this patent is extended or adjusted under 35 U.S.C. 154(b) by 0 days.

(21) Appl. No.: 15/345,380

(22) Filed: Nov. 7, 2016

(65) Prior Publication Data

US 2018/0128099 A1 May 10, 2018

(51) Int. Cl.

| | |
|---|---|
| ***E21B 47/16*** | (2006.01) |
| ***E21B 47/06*** | (2012.01) |
| ***E21B 47/18*** | (2012.01) |
| ***E21B 47/12*** | (2012.01) |

(52) U.S. Cl.

CPC ..... *E21B 47/16* (2013.01); *E21B 47/06* (2013.01); *E21B 47/18* (2013.01); *E21B 47/182* (2013.01); *E21B 47/12* (2013.01); *E21B 47/187* (2013.01)

(58) Field of Classification Search

CPC ..... E21B 47/12; E21B 47/14; E21B 47/18; E21B 47/182; E21B 47/185; E21B 47/187

See application file for complete search history.

(56) References Cited

U.S. PATENT DOCUMENTS

| | | | |
|---|---|---|---|
| 2,901,685 | A | 8/1959 | Alder |
| 2,964,116 | A | 12/1960 | Peterson |
| 2,973,505 | A | 2/1961 | Johannesen |
| 3,065,416 | A | 11/1962 | Jeter |
| 3,302,457 | A | 2/1967 | Mayes |

(Continued)

FOREIGN PATENT DOCUMENTS

| | | | |
|---|---|---|---|
| CA | 2629835 | C | 7/2010 |
| EP | 0140788 | A2 | 5/1985 |

(Continued)

OTHER PUBLICATIONS

Wassernann et al.; "How High-Speed Telemetry Affects the Drilling Process"; Society of Petroleum Engineers; Jun. 2009; 4 pages.

(Continued)

*Primary Examiner* — Franklin D Balseca

(74) *Attorney, Agent, or Firm* — Offit Kurman P.C.; Gregory A. Grissett

(57) ABSTRACT

A rotary pulser and method is disclosed that includes a housing, a stator supported by the housing, a rotor adjacent to the downhole end of the stator, and a motor assembly coupled to the rotor. A controller may receive a signal that includes drilling information. In response to receiving the signal, the controller causes the motor assembly to rotate the rotor in a first rotational direction through a rotation cycle. The rotation cycle a) rotates the rotor from a first position, where the rotor does not obstruct the at least one passage, into a second position, where the rotor obstructs the at least one passage, and b) rotates the rotor from the second position to a third position in the first rotational direction. Rotation of the rotor generates a pressure pulse in the drilling fluid.

43 Claims, 16 Drawing Sheets

(56) References Cited

U.S. PATENT DOCUMENTS

| | | | |
|---|---|---|---|
| 3,309,656 | A | 3/1967 | Godbey |
| 3,693,428 | A | 9/1972 | LePeuvedic et al. |
| 3,713,089 | A | 1/1973 | Clacomb |
| 3,732,728 | A | 5/1973 | Fitzpatrick |
| 3,736,558 | A | 5/1973 | Cubberly, Jr. |
| 3,737,843 | A | 6/1973 | LePeuvedic et al. |
| 3,739,331 | A | 6/1973 | Godbey et al. |
| 3,742,443 | A | 6/1973 | Foster et al. |
| 3,764,968 | A | 10/1973 | Anderson |
| 3,764,969 | A | 10/1973 | Cubberly, Jr. |
| 3,764,970 | A | 10/1973 | Manning |
| 3,770,006 | A | 11/1973 | Sexton et al. |
| 3,958,217 | A | 5/1976 | Spinnler |
| 3,964,556 | A | 6/1976 | Gearhart et al. |
| 4,007,805 | A | 2/1977 | Reber |
| RE29,734 | E | 8/1978 | Manning |
| RE30,055 | E | 7/1979 | Claycomb |
| 4,351,037 | A | 9/1982 | Scherbatskoy |
| 4,462,469 | A | 7/1984 | Brown |
| 4,499,563 | A | 2/1985 | Jurgens |
| 4,585,401 | A | 4/1986 | Baldenko |
| 4,628,495 | A | 12/1986 | Peppers et al. |
| 4,630,244 | A | 12/1986 | Larronde |
| RE32,463 | E | 7/1987 | Westlake et al. |
| 4,698,794 | A | 10/1987 | Kruger et al. |
| 4,734,892 | A | 3/1988 | Kotlyar |
| 4,785,300 | A | 11/1988 | Chin et al. |
| 4,790,393 | A | 12/1988 | Larronde et al. |
| 4,796,699 | A | 1/1989 | Upchurch |
| 4,847,815 | A | 7/1989 | Malone |
| 4,914,637 | A | 4/1990 | Goodsman |
| 4,915,168 | A | 4/1990 | Upchurch |
| 4,956,823 | A | 9/1990 | Russell et al. |
| 4,992,997 | A | 2/1991 | Bseisu |
| 5,073,877 | A | 12/1991 | Jeter |
| 5,079,750 | A | 1/1992 | Scherbatskoy |
| 5,113,379 | A | 5/1992 | Scherbatskoy |
| 5,119,344 | A | 6/1992 | Innes |
| 5,182,731 | A | 1/1993 | Hoelscher et al. |
| 5,189,645 | A | 2/1993 | Innes |
| 5,215,152 | A | 6/1993 | Duckworth |
| 5,357,483 | A | 10/1994 | Innes |
| 5,517,464 | A | 5/1996 | Lerner et al. |
| 5,586,084 | A | 12/1996 | Barron et al. |
| 5,636,178 | A | 6/1997 | Ritter |
| 5,691,712 | A | 11/1997 | Meek et al. |
| 5,787,052 | A | 7/1998 | Gardner et al. |
| 6,105,690 | A | 8/2000 | Biglin, Jr. et al. |
| 6,219,301 | B1 | 4/2001 | Moriarty |
| 6,244,844 | B1 | 6/2001 | Diaz |
| 6,289,998 | B1 | 9/2001 | Krueger et al. |
| 6,469,637 | B1 | 10/2002 | Seyler et al. |
| 6,626,253 | B2 * | 9/2003 | Hahn ..... E21B 47/18 175/48 |
| 6,714,138 | B1 * | 3/2004 | Turner ..... E21B 47/18 340/854.3 |
| 7,327,634 | B2 | 2/2008 | Perry et al. |
| 7,468,679 | B2 | 12/2008 | Feluch |
| RE40,944 | E * | 10/2009 | Seyler ..... E21B 47/187 181/102 |
| 7,997,380 | B2 | 8/2011 | Arian et al. |
| 2003/0183388 | A1 | 10/2003 | Toulouse et al. |
| 2006/0034154 | A1 | 2/2006 | Perry et al. |
| 2006/0215491 | A1 | 9/2006 | Hall |
| 2006/0283632 | A1 | 12/2006 | Hall et al. |
| 2007/0182583 | A1 | 8/2007 | Feluch |
| 2010/0230113 | A1 | 9/2010 | Hutin et al. |
| 2012/0199344 | A1 | 8/2012 | McGarian |
| 2012/0211251 | A1 | 8/2012 | Konschuh et al. |
| 2013/0105221 | A1 | 5/2013 | Wassell |
| 2014/0124693 | A1 | 5/2014 | Gopalan et al. |
| 2015/0247403 | A1 | 9/2015 | Logan et al. |
| 2015/0292322 | A1 * | 10/2015 | Logan ..... E21B 47/18 166/330 |
| 2016/0245079 | A1 * | 8/2016 | Perry ..... E21B 47/182 |

FOREIGN PATENT DOCUMENTS

| | | | |
|---|---|---|---|
| EP | 0309030 | A1 | 3/1989 |
| EP | 0325047 | A2 | 7/1989 |
| EP | 0747571 | A2 | 12/1996 |
| GB | 2156405 | A | 10/1985 |
| GB | 2407598 | A | 5/2005 |
| GB | 2415977 | A | 1/2006 |
| WO | WO 2002/029441 | A1 | 4/2002 |
| WO | WO 2013/074070 | A1 | 5/2013 |
| WO | 2013142754 | A1 | 9/2013 |
| WO | 2015196289 | A1 | 12/2015 |
| WO | 2016127252 | A1 | 8/2016 |
| WO | 2016137869 | A1 | 9/2016 |

OTHER PUBLICATIONS

Chin, W.C. Ph.D., "NWD Siren Pulser Fluid Mechanics", StrataMegnetic Software, LLC, Houston Texas, Aug. 4, 2003, p. 1-23.

Calmena Energy Services.sub.—Cyclone.TM. NC-RP Non Compensated Rotary Pulser brochure.sub.—DTB2010.2e.; Drilling Technologies; 2 pages.

Pulse Directional Technologies Inc., I-Pulse Brochure. 2 pages.

International Application No. PCT/US2016/018883: International Search Report and the Written Opinion dated Apr. 29, 2016, 12 pages.

IPO Search Report Under Section 17(5) dated Mar. 6, 2018, in related application GB1718190.0. 5 pages.

* cited by examiner

MUD-PULSE TELEMETRY SYSTEM INCLUDING A PULSER FOR TRANSMITTING INFORMATION ALONG A DRILL STRING

TECHNICAL FIELD

The present disclosure relates to a mud-pulse telemetry system including a pulser for transmitting information along a drill string, methods for transmitting information along a drill string, and methods for assembling such pulsers.

BACKGROUND

Drilling systems are designed to drill a bore into the earth to target hydrocarbon sources. Drilling operators rely on accurate operational information to manage the drilling system and reach the target hydrocarbon source as efficiently as possible. The downhole end of the drill string in a drilling system, referred to as a bottomhole assembly, can include specialized tools designed to obtain operational information for the drill string and drill bit, and in some cases characteristics of the formation. In measurement-while-drilling (MWD) applications, sensing modules in the bottomhole assembly provide information concerning the direction of the drilling. This information can be used, for example, to control the direction in which the drill bit advances in a rotary steerable drill string.

In "logging while drilling" (LWD) applications, characteristics of the formation being drilled through is obtained. For example, resistivity sensors may be used to transmit, and then receive, high frequency wavelength signals (e.g., electromagnetic waves) that travel through the formation surrounding the sensor. Other sensors are used in conjunction with magnetic resonance imaging (MRI). Still other sensors include gamma scintillators, which are used to determine the natural radioactivity of the formation, and nuclear detectors, which are used to determine the porosity and density of the formation. In both LWD and MWD applications, the information collected by the sensors can be transmitted to the surface for analysis. One technique for transmitting date between surface and downhole location is "mud pulse telemetry." In a mud pulse telemetry system, signals from the sensor modules are received and encoded in a module housed in the bottomhole assembly. A controller actuates a pulser, also incorporated into the bottomhole assembly, which generates pressure pulses in the drilling fluid flowing through the drill string and out of the drill bit. The pressure pulses contain the encoded information. The pressure pulses travel up the column of drilling fluid to the surface, where they are detected by a pressure transducer. The data from the pressure transducers are then decoded and analyzed as needed. Such pulsers have relatively low data rates and consume large amounts of power.

SUMMARY

An embodiment of the present disclosure includes a rotary pulser configured to be positioned along a drill string through which a drilling fluid flows. The rotary pulser includes a housing configured to be supported in an internal passage of a drill string, and a stator supported by the housing. The stator includes an uphole end, a downhole end spaced from the uphold end, and at least one passage that extends from the uphole end to the downhole end. The rotary pulser also includes a rotor adjacent to the downhole end of the stator, as well as a motor assembly coupled to the rotor.

The motor assembly is operable to rotate the rotor relative to the stator. The rotary pulser further includes a controller configured to receive a signal that includes drilling information. The controller, in response to receiving the signal, may cause the motor assembly to rotate the rotor in a first rotational direction through a rotation cycle so as to: a) rotate the rotor from a first position, where the rotor does not obstruct the at least one passage, into a second position in the first rotational direction, where the rotor obstructs the at least one passage, and b) rotate the rotor from the second position to a third position in the first rotational direction. Rotation of the rotor through the rotation cycle when drilling fluid is flowing through the drill string generates a pressure pulse in the drilling fluid that contains the information.

Another embodiment of the present disclosure includes a rotary pulser configured to be positioned along a drill string through which a drilling fluid flows. The rotary pulser includes a housing configured to be supported in an internal passage of a drill string, and a stator supported by the housing. The stator includes an uphole end, a downhole end spaced from the uphold end, and at least one passage that extends from the uphole end to the downhole end. Additionally, the rotary pulser includes a rotor adjacent to the downhole end of the stator, and a motor assembly coupled to the rotor. The motor assembly is operable to rotate the rotor relative to the stator so as to selectively obstruct the at least one passage. Further, the rotary pulser includes a power source configured to supply energy to the motor assembly. The rotary pulser also includes a controller configured to receive a signal that includes drilling information. The controller, in response to receiving the signal, may cause the motor assembly to rotate the rotor in a first rotational direction through a rotation cycle to generate a pressure pulse in the drilling fluid. The rotation cycle may include an intermediate phase where the rotor obstructs a flow of the drilling fluid through the at least one passage. The motor assembly may pull no greater than about 6.0 Joules from the power source to rotate when rotating the rotor through the rotation cycle to generate the pressure pulse.

Another embodiment of the present disclosure includes a method of transmitting information from a downhole location along a drill string in a well bore formed in an earthen formation toward a surface of the earthen formation. The method includes directing a drilling fluid through an elongated passage of the drill string in a downhole direction toward a rotary pulser mounted to drill string in the elongated passage. The rotary pulser comprises a stator that includes at least one passage, and a rotor adjacent to a downhole end of the stator. The rotor includes at least one blade. The method may also include rotating the rotor in a first rotational direction relative to the stator from a first position, where the rotor permits the flow of drilling fluid to pass through the at least one passage, to a second position, where the rotor obstructs the flow of drilling fluid through the at least one passage. The method may also include further rotating the rotor in the first rotational direction from the second position to a third position, where the rotor permits the flow of drilling fluid to pass through the at least one passage. Rotation of the rotor in the first rotational direction from the first position to the third position generates a pressure pulse in the drilling fluid that contains the information.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 1:
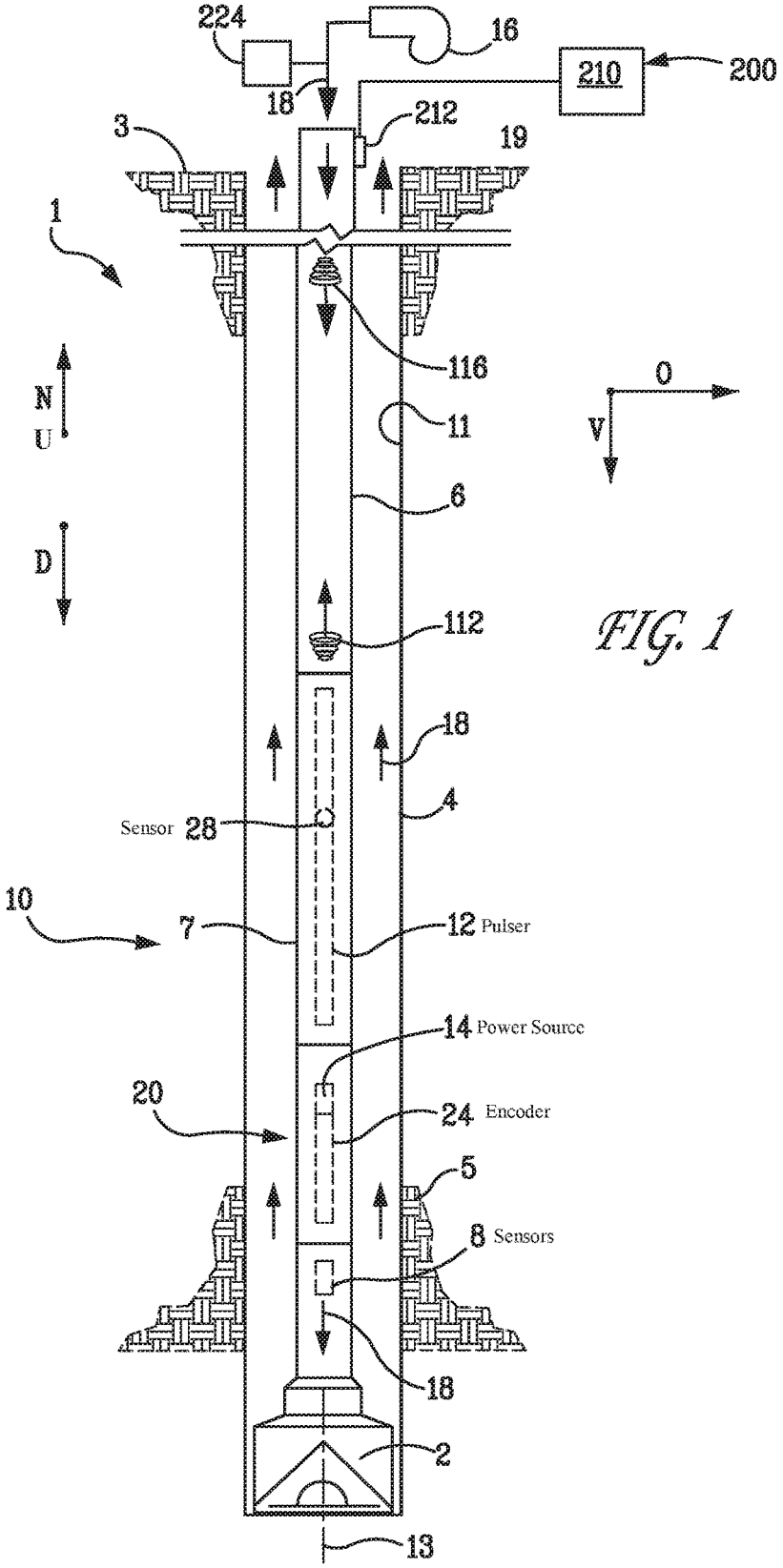
FIG. 1 is a schematic side view of a drilling system employing a telemetry system according to an embodiment of the present disclosure.

Referring to FIG. 1, an embodiment of the present disclosure is a mud-pulser telemetry system 10 for operation in a drilling system 1. The drilling system 1 includes a rig or derrick (not shown) that supports a drill string 6, a bottomhole assembly (BHA) 7 forming a portion of the drill string 6, and a drill bit 2 coupled to the bottomhole assembly 7. The drill bit 2 is configured to drill a borehole 4 into the earthen formation 5 according to known methods of drilling. The mud-pulse telemetry system 10 is configured to transmit drilling information obtained in the bore 4 to the surface 3 during a drilling operation.

According to an embodiment of the present disclosure, the mud-pulse telemetry system 10 includes a pulser 12, such as a rotary pulser, disposed along the drill string 6, a measurement-while-drilling (MWD) tool 20 attached to or suspended within the drill string 6 and configured to obtain drilling information, and one or more components to all of the surface system 200. The mud-pulse telemetry system 10 transmits drilling information obtained by the MWD tool 20 to the surface 3, via the pulser 12, for processing and analysis by the surface system 200. The pulser 12 as described here can generate relatively higher data rates while consuming considerably less power compared to typical pulsers. The pulser 12 as described herein is therefore more efficient and reliably transmits information uphole to aid the drilling operator in drilling the well bore.

Continuing with FIG. 1, the drilling system 1 can include a surface motor (not shown) located at the surface 3 that applies torque to the drill string 6 via a rotary table or top drive (not shown) and a downhole motor (not shown), or "mud motor," disposed along the drill string 6 and operably coupled to the drill bit 2. Operation of the surface and downhole motors causes the drill string 6 and drill bit 2 to rotate and drill into the formation 5. Further, during the drilling operation, a pump 16 pumps drilling fluid 18 downhole through an internal passage of the drill string 6 to the drill bit 2. The drilling fluid 18 exits the bit 2 and flows upward to the surface 3 through the annular passage between wall 11 of the bore 4 and the drill string 6, where, after cleaning, it is circulated back down the drill string 6 by the mud pump 16.

The drilling system 1 is configured to drill the borehole or well 4 into the earthen formation 5 along a vertical direction V and an offset direction O that is offset from or deviated from the vertical direction V. Although a vertical bore 4 is illustrated, the drilling system 1 and components thereof as described herein can be used for a directional drilling operations whereby a portion of the bore 4 is offset from the vertical direction V along the offset direction O. The drill string 6 is typically formed of sections of drill pipe joined along a longitudinal central axis 13. The drill sting 6 is supported at its uphole end 19 by the Kelly or top drive and extends toward the drill bit 2 along a downhole direction D. The downhole direction D is the direction from the surface 3 toward the drill bit 2 while an uphole direction U is opposite to the downhole direction D. Accordingly, "downhole," "downstream," or similar words used in this description refers to a location that is closer toward the drill bit 2 than the surface 3, relative to a point of reference. "Uphole," "upstream," and similar words refers to a location that is closer to the surface 3 than the drill bit 2, relative to a point of reference.

Continuing with FIG. 1, the mud pulse telemetry system 10 can include all or a portion of the MWD tool 20. The MWD tool 20 includes a plurality of sensors 8, an encoder 24, a power source 14, and a transmitter (or transceiver) for communication with the pulser 12. The MWD tool 20 can also include a controller having a processor and memory. The MWD tool 20 obtains drilling information via the sensors 8. Exemplary drilling information may include data indicative of the drilling direction of the drill bit 2, such as azimuth, inclination, and tool face angle. While MWD tool 20 is illustrated, a logging-while-drilling (LWD) tool may be used in combination with or in lieu of the MWD tool 20. The power source 14 can be a battery, a turbine alternator-generator, or a combination of both.

Continuing with FIG. 1, the mud pulse telemetry system 10 can include one or more up to all of the components of the surface system 200. The surface system 200 includes one or more computing devices 210, a pressure sensor 212, and a pulser device 224. The pressure sensor 212 may be a transducer that senses pressure pulses in the drilling fluid 18. The pulser device 224, which may be a valve, is located at the surface 3 and is capable of generating pressure pulses in the drilling fluid 18. The surface system 200 can include any suitable computing device 210 configured to host software applications that process drilling data encoded in the pressure pulses and further monitor and analyze drilling operations based on the decoded drilling operation. The computing device includes a processing portion, a memory portion, an input/output portion, and a user interface (UI) portion. The input/output portions can include receivers and transceivers for detecting signals from the pressure sensor. Demodulators can be used to process received signals and are configured to demodulate received signals into drilling data that is stored in the memory portion for access by the processing portion as needed. It will be understood that the computing device 210 can include any appropriate device, examples of which include a desktop computing device, a server computing device, or a portable computing device, such as a laptop, tablet or smart phone.

Figure 2:
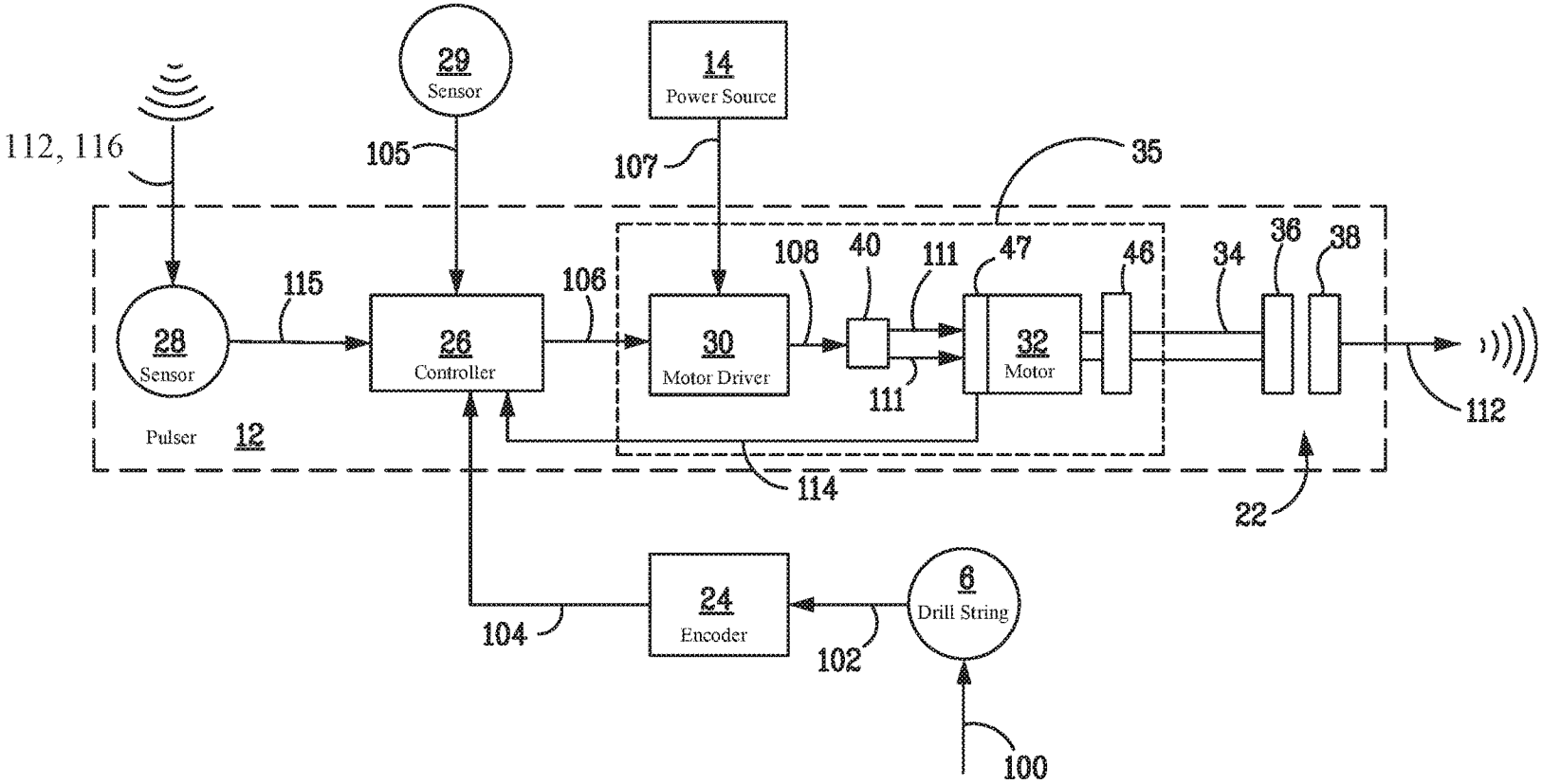
FIG. 2 is a schematic diagram of the telemetry system illustrated in FIG. 1.
Figure 3:
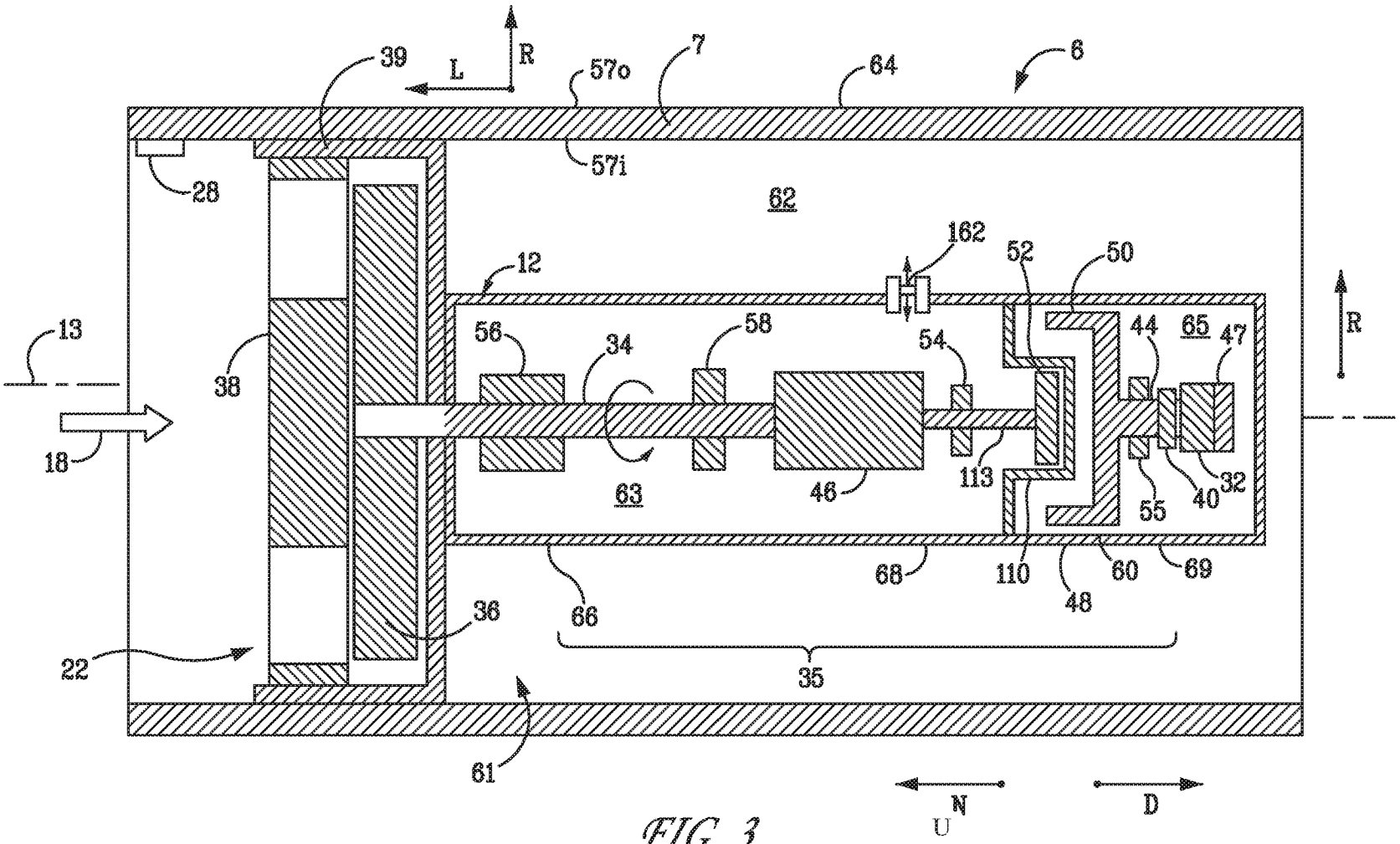
FIG. 3 is a schematic diagram of a pulser employed in the telemetry system shown in FIG. 1.

Turning now to FIGS. 1 and 2, in accordance with an embodiment of the present disclosure, the pulser 12 includes a controller 26, and a motor assembly 35 operably coupled to a pulser assembly 22. The pulser assembly 22 includes a rotor 36 and a stator 38 contained with a housing assembly 61 (FIG. 3). The pulser 12 is configured to cause the rotor 36 to rotate relative to the stator 38 between various rotational positions as drilling fluid 18 passes through pulser 12. Transition of rotor 36 through the different rotational positions generates pressure pulses 112 in the drilling fluid 18 which contain encoded drilling information, as will be described further below.

The motor assembly 35 includes a motor driver 30, a motor 32, switching device 40, and a reduction gear 46 coupled to a shaft 34. The housing assembly 61 includes a housing 39 or shroud that is supported by the inner surface of the drill string 6. The rotor 36 is coupled to shaft 34 and is further disposed adjacent to the stator 38 within the housing 39. The motor driver 30 receives power from the power supply 14 and directs power to the motor 32 using pulse width modulation. In one exemplary embodiment, the motor 32 is a brushed DC motor with an operating speed of at least about 600 RPM and, preferably, about 6000 RPM. In response to power supplied by the motor driver 30, the motor 32 drives the reduction gear 46 causing rotation of the shaft 34. Although only one reduction gear 46 is shown, two or more reduction gears could be used. In one exemplary embodiment, the reduction gear 46 can achieve a speed reduction of at least about 144:1.

The pulser 12 may also include an orientation encoder 47 coupled to the motor 32. The orientation encoder 47 can monitor or determine angular orientation of the rotor 36. In response to determining the angular orientation of the rotor 36, the orientation encoder 47 directs a signal 114 (FIG. 2) to the controller 26 containing information concerning the angular orientation of the rotor 36. The controller 26 may use angular orientation information of the rotor 36 during operation of the pulser 12 to generate the motor control signals 106, which cause the rotational position of the rotor 36 to change as needed. Further, information from the orientation encoder 47 can be used to monitor the position of the rotor 36 during periods when the pulser 12 is not in operation. The orientation encoder 47 is of the type employing a magnet coupled to the motor shaft that rotates within a stationary housing in which Hall effect sensors are mounted that detect rotation of the magnetic poles of the magnet. The orientation encoder 47 should be suitable for high temperature operations.

Operation of the pulser 12 to transmit drilling information to the surface 3 initiates with sensors 8 in the MWD tool 20 obtaining drilling information 100 useful in connection with the drilling operation. The MWD tool 20 provides output signals 102 to the data encoder 24. The data encoder 24 transforms the output signals 102 from the sensors 8 into digital signals 104 and transmits the signals 104 to the controller 26. In response to receiving the digital signals 104, the controller 26 directs operation of the motor assembly 35. For instance, the controller 26 directs signals 106 to the motor driver 30. The motor driver 30 receives power 107 from the power source 14 and directs power 108 to the switching device 40. The switching device 40 transmits power 111 to motor 32 so as to effect rotation of the rotor 36 in either a first rotational direction T1 (e.g., clockwise) or a second rotational direction T2 (e.g., counterclockwise) in order to generate pressure pulses 112 that are transmitted through the drilling fluid 18. The first and second rotational directions T1 and T2 are shown in FIGS. 16-19. The pressure pulses 112 are sensed by the sensor 212 at the surface 3 and the information is decoded by the surface computing device 210.

The mud-pulse telemetry system 10 can also include one or more downhole pressure sensors. For instance, the drill string 6 can include dynamic downhole pressure sensor 28 and a static downhole pressure sensor 29. The downhole pressure sensors 28 and 29 are configured to measure the pressure of the drilling fluid 18 in the vicinity of the pulser 12 as described in U.S. Pat. No. 6,714,138 (Turner et al.). The pressure pulses sensed by the dynamic pressure sensor 28 may be the pressure pulses 112 generated by the pulser 12 or the pressure pulses 116 generated by the surface pulser 224. In either case, the down hole dynamic pressure sensor 28 transmits a signal 115 to the controller 26 containing the pressure pulse information, which may be used by the controller 26 in generating the motor control signals 106 which cause or control operation of the motor assembly 35. The static pressure sensor 29, which may be a strain gage type transducer, transmits a signal 105 to the controller 26 containing information on the static pressure.

Figure 4:
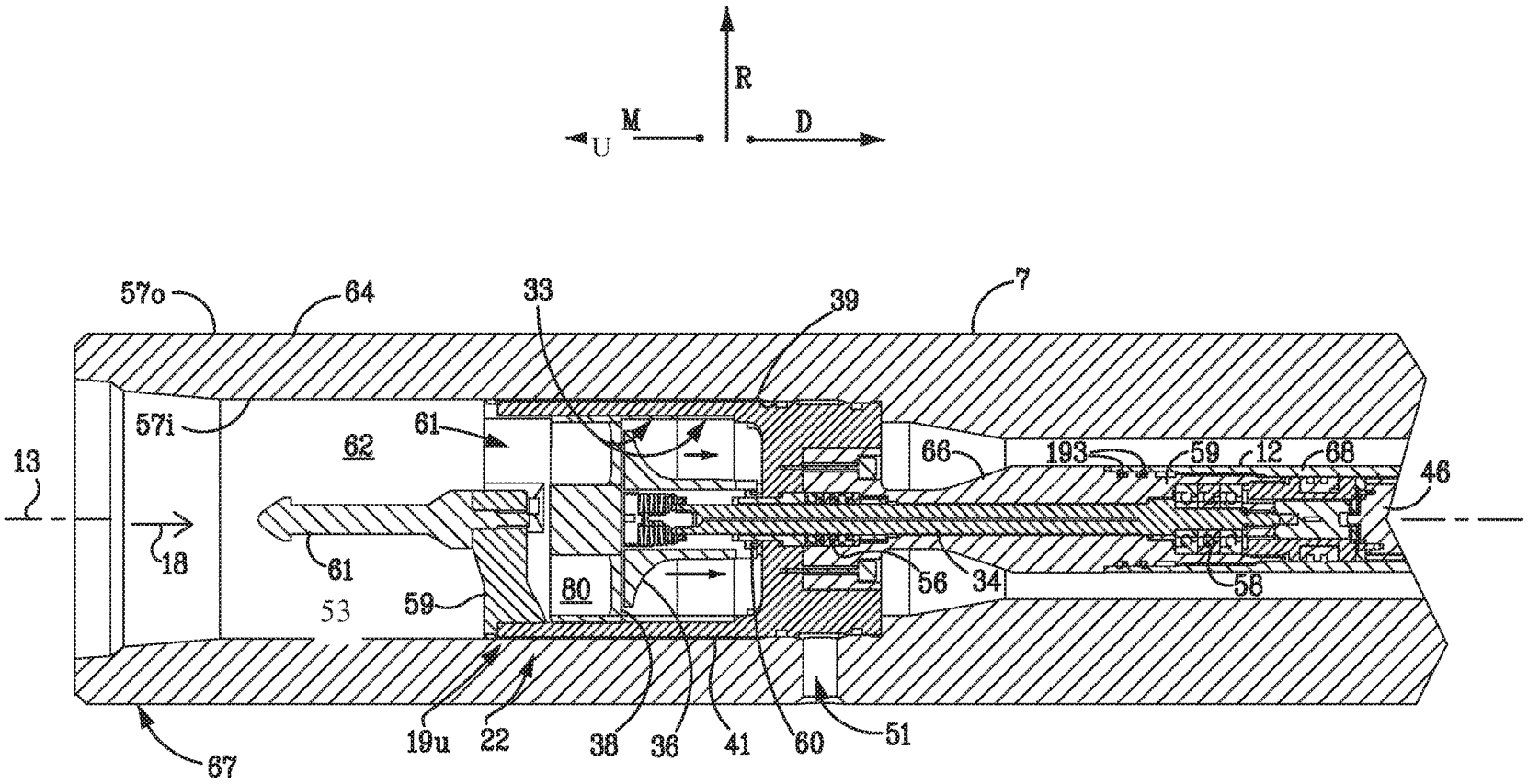
FIGS. 4-6 are cross-sectional detailed views of consecutive portions of the bottomhole assembly of the drill string shown in FIG. 1, illustrating the pulser employed in the drilling system shown in FIG. 1.
Figure 5:
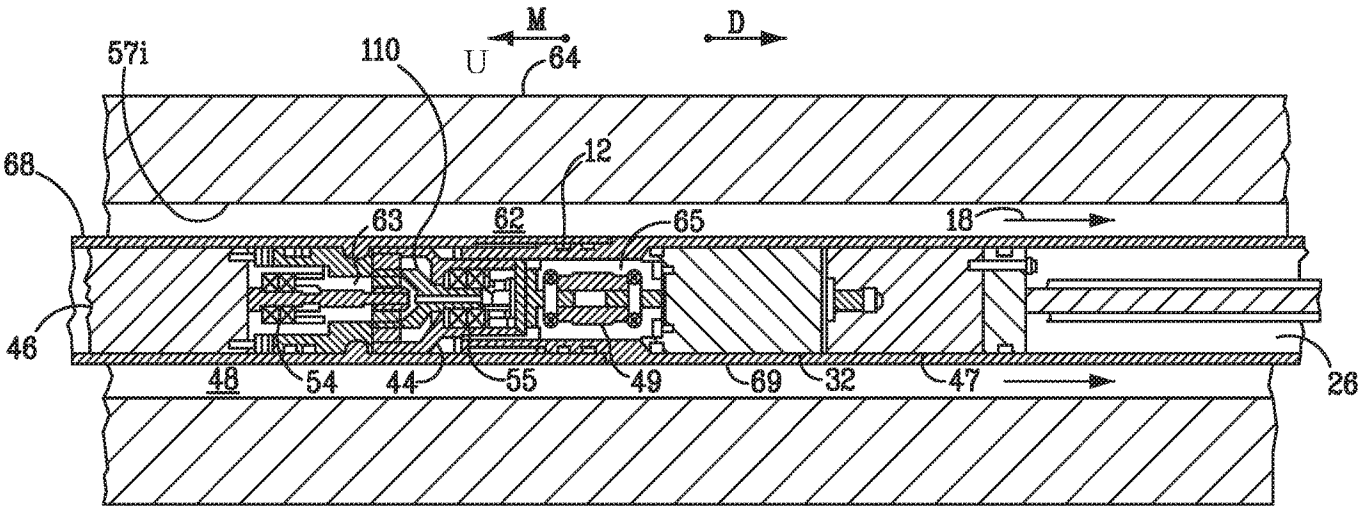
Figure 6:
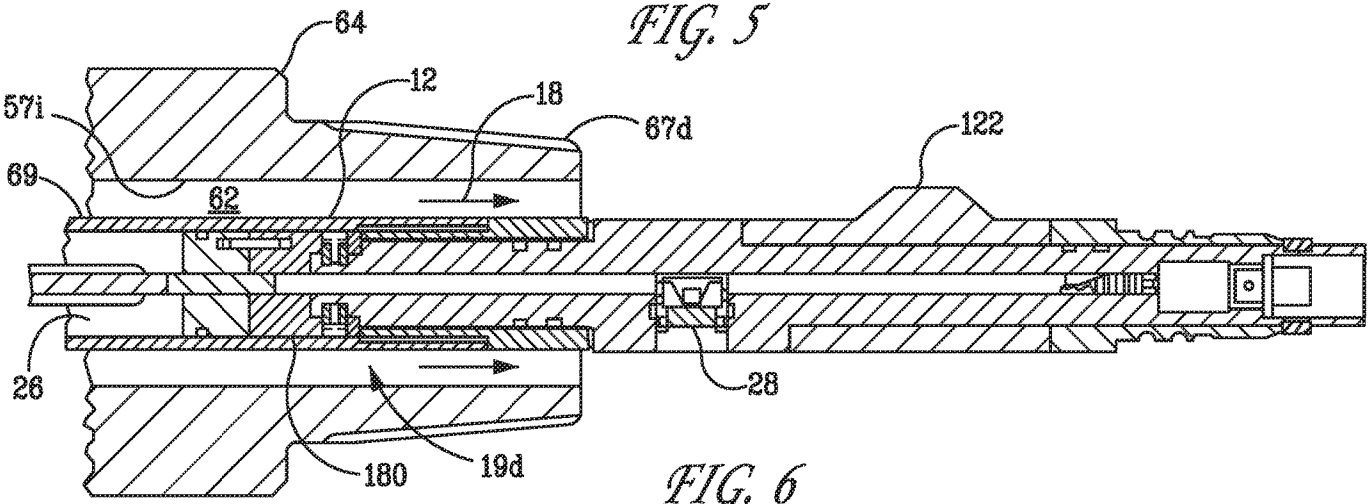

An exemplary mechanical arrangement of the pulser 12 is shown schematically in FIG. 3. The pulser 12 illustrated schematically in FIG. 3 is shown in greater detail in FIGS. 4-6. Accordingly, FIGS. 3-6 include like reference numbers for the pulser 12. FIG. 4 shows the upstream portion of the pulser 12, FIG. 5 shows the middle portion of the pulser 12, and FIG. 6 shows the downstream portion of the pulser 12. The construction of the middle and downstream portions of the pulser are described in U.S. Pat. No. 6,714,138 to Turner et al.

Turning now to FIGS. 3-6, a section of drill pipe 64 is configured to support the pulser 12. The drill pipe section 64 includes an inner surface 57*i* and an outer surface 57*o* spaced from the inner surface 57*i* along a radial direction R that is perpendicular to a longitudinal (or axial) direction L. The longitudinal direction L is aligned with the longitudinal central axis 13. The drill pipe section 64, for instance, the inner surface 57*i*, defines a central passage 62 through which the drilling fluid 18 flows in the downhole direction D. The drill pipe section 64 includes a downhole end 67*d* (FIG. 4) and an uphole end 67*u*. The downhole end 67*d* and the uphole end 67*u* include threaded couplings for connection with other sections of drill pipe.

As shown in FIGS. 3-6, the pulser 12 can be supported within the passage 62 of the drill pipe section 64. The pulser 12 includes an upstream end 17*u* and a downstream end 17*d* spaced from the upstream end 17*u* in the downhole direction D. The housing assembly 61 includes the housing 39 or uphole housing segment 39, intermediate housing segments 66 and 68, and downstream housing segment 69. The housings segments 39, 66, 68, and 69 can be coupled end to end between the upstream end 17*u* and the downstream end 17*d*. As shown in FIG. 4, the upstream end 19*u* of the pulser 12 is mounted in the passage 62 by the housing 39. As shown in FIG. 6, the downstream end 19*d* of the pulser 12 is attached via coupling 180 to a centralizer 122 that further supports the pulser 12 within the passage 62. The upstream end 17*u* includes the housing shroud 39 and is mounted to the inner surface 57*i* of the drill pipe 64. A nose 53 forms the forward-most portion of the pulser 12 and is attached to a retainer 59 that is coupled to the housing 39.

Figure 7:
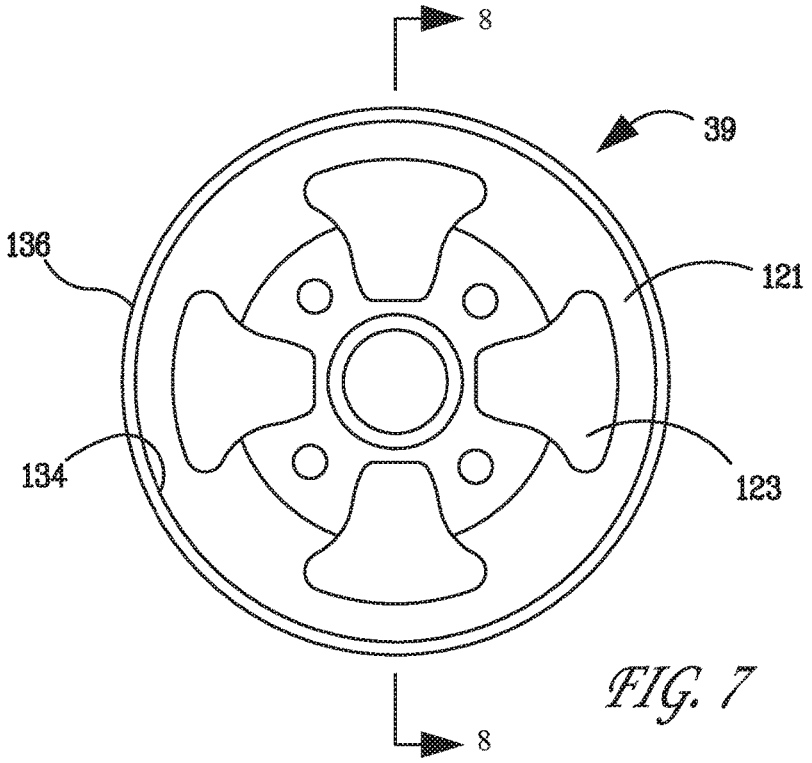
FIG. 7 is an end view of an annular housing that supports the pulser shown in FIGS. 3-6.
Figure 8:
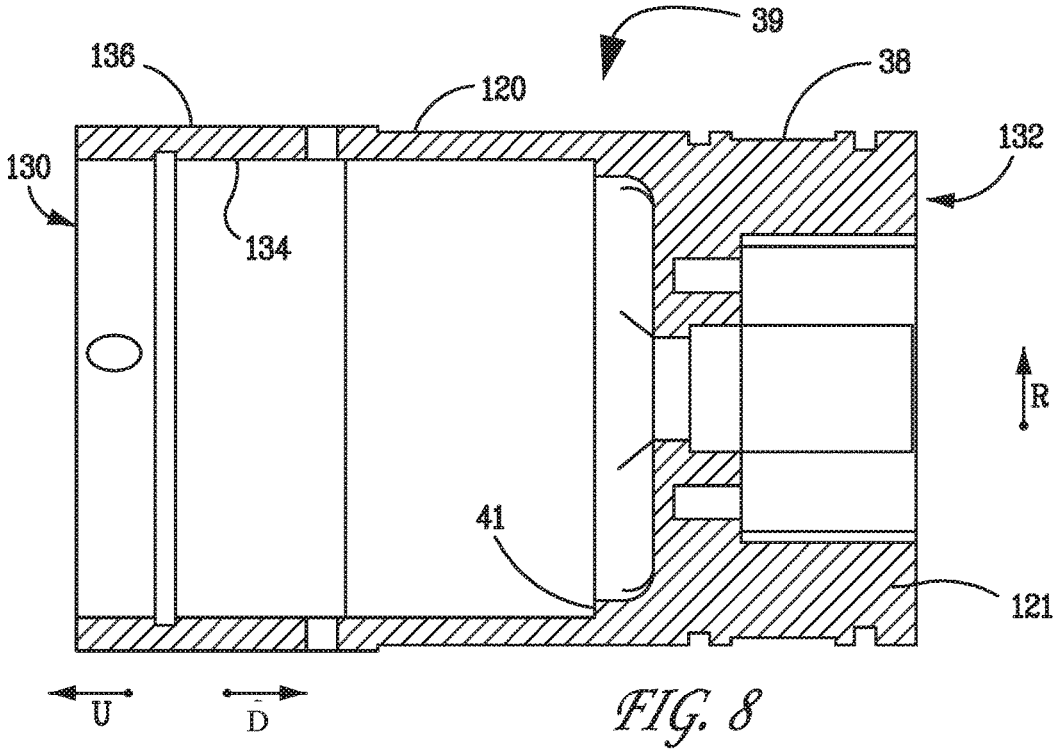
FIG. 8 is a cross-sectional view of the annular housing, taken along line 8-8 in FIG. 7.

Turning to FIGS. 7 and 8, the housing shroud 39 comprises a sleeve 120 forming a shroud for the rotor 36 and stator 38, and an end plate 121 disposed downhole from the sleeve 120 in the downhole direction D. The housing shroud 39 also includes an upstream end 130, a downstream end 132 spaced from the upstream end 130 in the downhole direction D, an inner surface 134, and an outer surface 136 spaced from the inner surface 134 along the radial direction R. The housing 39 can include tungsten carbide wear sleeves 33 (shown in FIG. 4) disposed along the inner surface 134 of the sleeve portion 120. The wear sleeves 33 enclose the rotor 36 and protect the inner surface 134 of the housing 39 from wear as a result of contact with the drilling fluid 18. The end plate 121 is disposed at the downstream end 132 of the housing 39 and defines passages 123 that extend therethrough in the downhole direction D. The end plate passages 123 are configured to allow drilling fluid 18 to flow through the housing 39. The housing 39 can be fixed within the drill pipe 64 by a set screw (not shown) that is inserted into a hole 51 (FIG. 4) in the drill pipe.

Turning back to FIGS. 3-5, the rotor 36 and stator 38 are mounted within the housing shroud 39. In accordance with an embodiment of the present disclosure, the rotor 36 is located downstream and adjacent to the stator 38. The rotor 36 is spaced from the stator 38 to define a gap G (not shown). The stator retainer 59 is threaded into the upstream end 130 of the housing shroud 39 and restrains the stator 38 and the wear sleeves 33 from axial motion by compressing them against a shoulder 41 formed by the inner surface 134 of the housing 39. As needed, the wear sleeves 33 can be replaced. Moreover, since the stator 38 and wear sleeves 33 are not highly loaded, they can be made of a brittle, wear resistant material, such as tungsten carbide, while the housing 39, which is more heavily loaded but not as subject to wear from the drilling fluid 18, can be made of a more ductile material, such as stainless steel. In an exemplary embodiment, the housing 39 is made of 17-4 stainless steel.

Continuing with FIGS. 3 and 4, the motor assembly 35 is mounted in the housing segments 66, 68, and 69 downstream from the housing shroud 39. The housing segments 66 and 68 together with a seal 60 and a barrier member 110 define an upstream chamber 63. The downstream housing segment 69 and the barrier member 110 define a downstream chamber 65. The rotor shaft 34 is mounted to upstream and downstream bearings 56 and 58 in the upstream chamber 63. The seal 60 can be a spring loaded lip seal. The chamber 63 is filled with liquid, preferably lubricating oil, pressurized to an internal pressure that is close to that of the external pressure of the drilling fluid 18 in passage 62 by a piston 162 mounted in the upstream housing segment 66. The housing segments 66 and 68 that form the chamber 63 are threaded together and sealed by O-rings 193 (FIG. 5). The downstream end of the rotor shaft 34 is attached by a coupling 182 to the output shaft 113 of the reduction gear 46, which is also mounted in the housing segment 68. The input shaft 113 extends from the reduction gear 46 and is supported by a bearing 54. A downhole end (not numbered) of the shaft 113 is coupled a magnetic coupling 48. The magnetic coupling includes an inner or first part 52 supported by the input shaft 113 in the chamber 63, and an outer or second part 50 is disposed in the chamber 65. The motor 32 rotates a shaft 44 which, via the magnetic coupling 48, transmits torque through the housing barrier 110 that drives the input shaft 113. The reduction gear drives the rotor shaft 34, thereby rotating the rotor 36 between the desired rotational positions relative to stator 38. The outer part 50 of the magnetic coupling 48 is mounted within the downstream chamber 65 that is filled with a gas, preferably air. The outer magnetic coupling part 50 is coupled to the shaft 44 which is supported on bearings 55. A flexible coupling 49 couples the shaft 44 to the motor 32.

Continuing with FIGS. 3 and 4, the motor assembly 35 operates to change the rotational position of the rotor 36 relative to stator 38 to generate pressure pulses in the drilling fluid. In accordance with the illustrated embodiment, the motor assembly 35 causes the rotor 36 to rotate through repeated rotation cycles. A first rotation cycle includes rotating the rotor 36 from a first open position P1 (FIG. 16) where drilling fluid 18 is permitted to pass through the stator 38, to a second closed position P2 (FIG. 17) where the rotor 36 at least partially obstructs the flow of drilling fluid through the stator 38. The rotor 36 is held in the second closed position for a period of time. Then, the rotor 36 is rotated in the same direction into a third open position P3 (FIG. 18) or P3' (FIG. 19), where drilling fluid 18 is permitted to pass through the stator 38 again. Transition of the rotor through the three positions P1, P2, and P3 or P3' generates a pressure pulse in the drilling fluid 18. The controller 26 can cause the rotor to transition to the first open position P1 in reverse order in a second rotation cycle. Alternatively, the rotor 36 can be rotated in the second direction from the second position P2 to a fourth position P4 that is rotationally between first position P1 and second position P2. The controller 26 can operate the motor assembly 35 to cause the rotational position of the rotor 36 to change according to a pattern or interval such that the drilling information obtained from the sensors 8 is encoded in the series of pressure pulses 112 generated by the pulser 12.

In one embodiment, in the third open position P3, the rotor 36 is positioned relative to the stator 38 such that the drilling fluid 18 is completely unobstructed as it flows through the stator 38. In another embodiment, in the third open position P3', the rotor 36 is positioned relative to the stator 38 such that the rotor 36 partially obstructs the flow of drilling fluid 18 through the stator 38.

Figure 9:
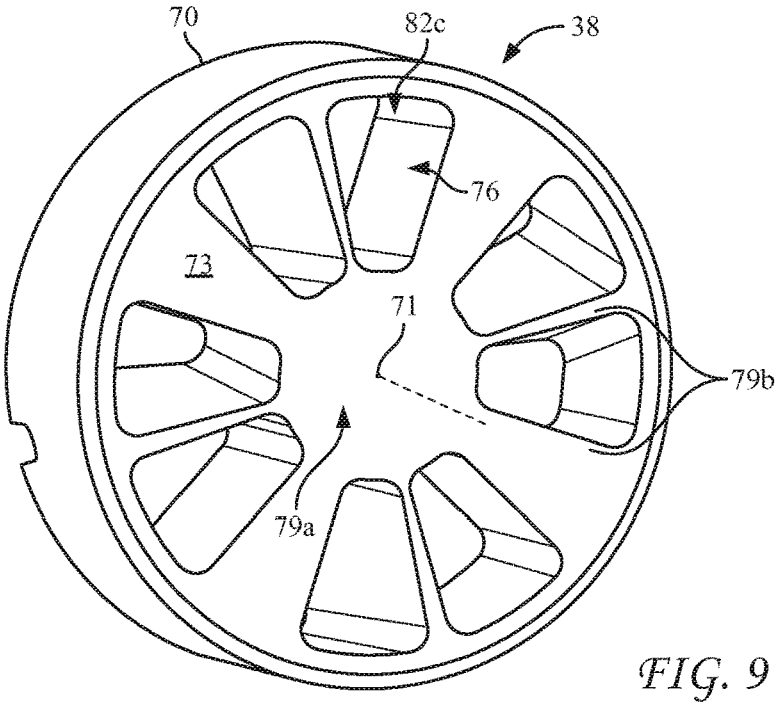
FIG. 9 is a top perspective view of the stator shown in FIGS. 3-6.
Figure 10:
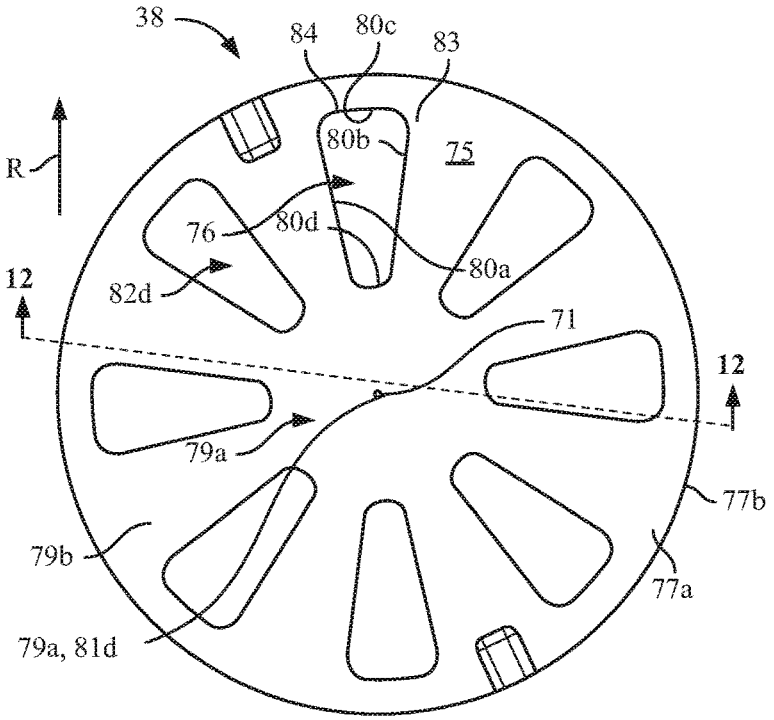
FIG. 10 is a bottom view of the stator shown in FIG. 9.
Figure 11:
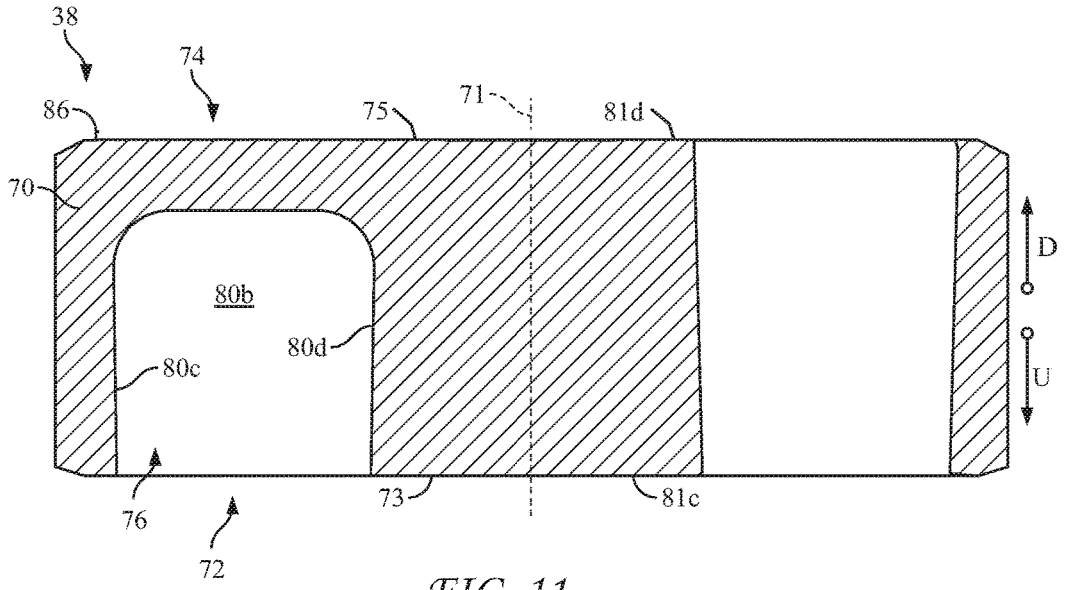
FIG. 11 is a cross-sectional view of the stator taken along line 11-11 in FIG. 10.
Figure 12:
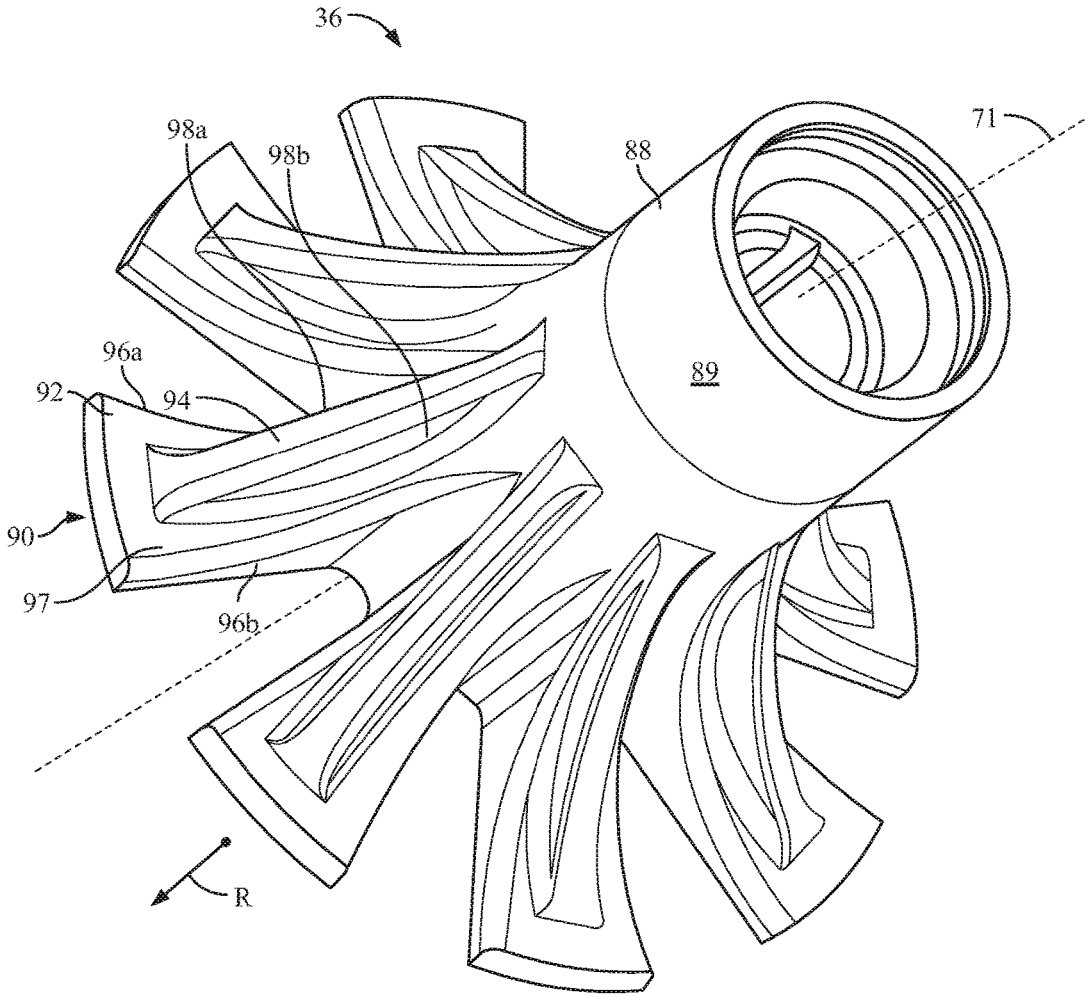
FIG. 12 is a bottom perspective view of a rotor of the pulser shown in FIGS. 3-6.
Figure 14:
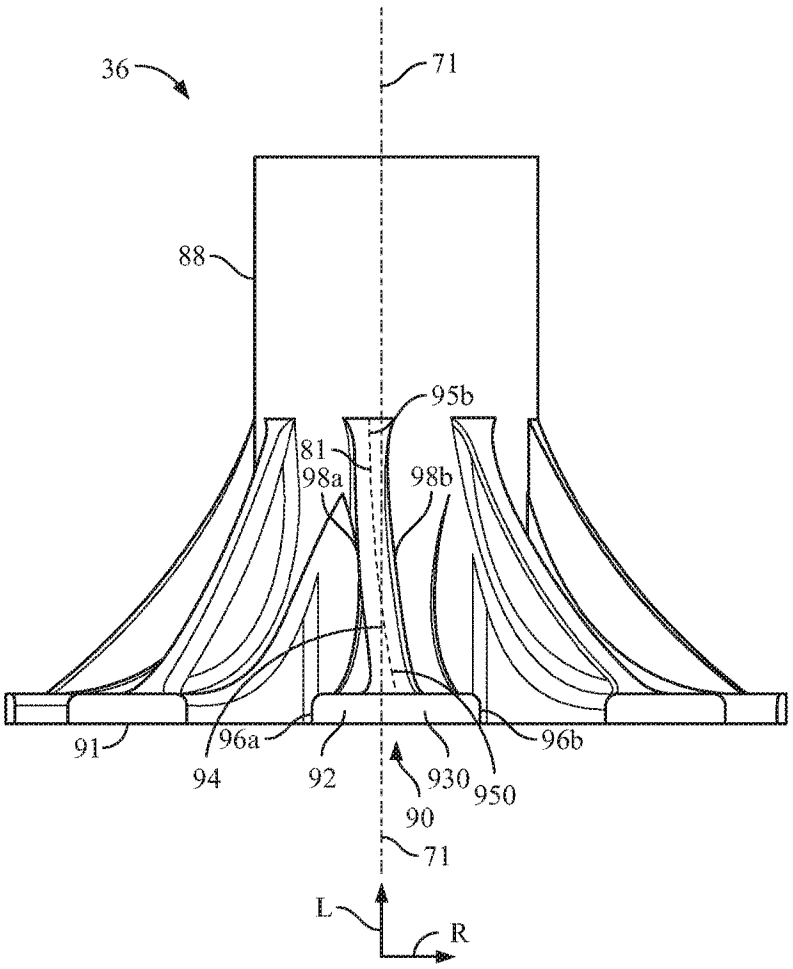
FIG. 14 is a side view of the rotor shown in FIG. 12.
Figure 13:
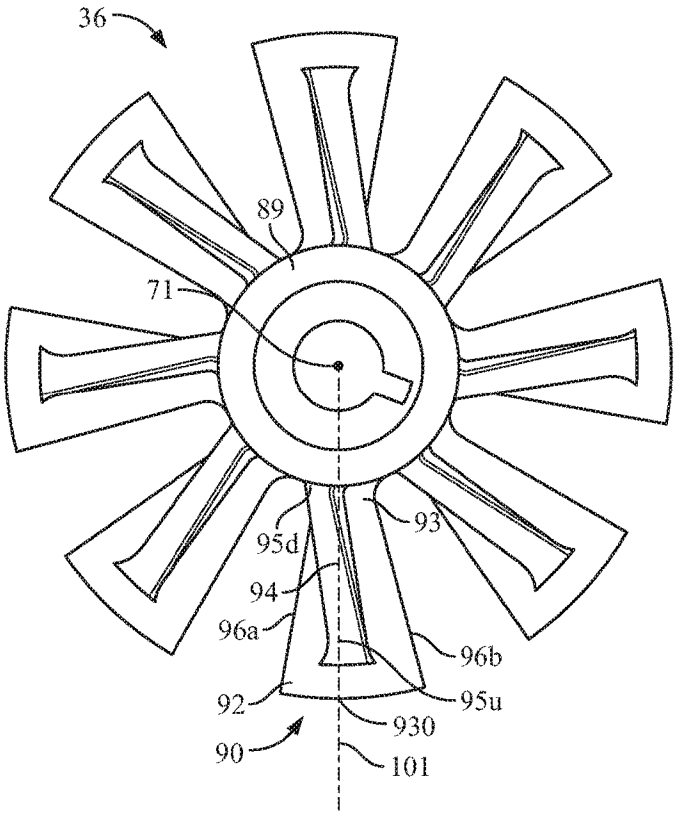
FIG. 13 is a bottom view of the rotor shown in FIG. 12.
Figure 15:
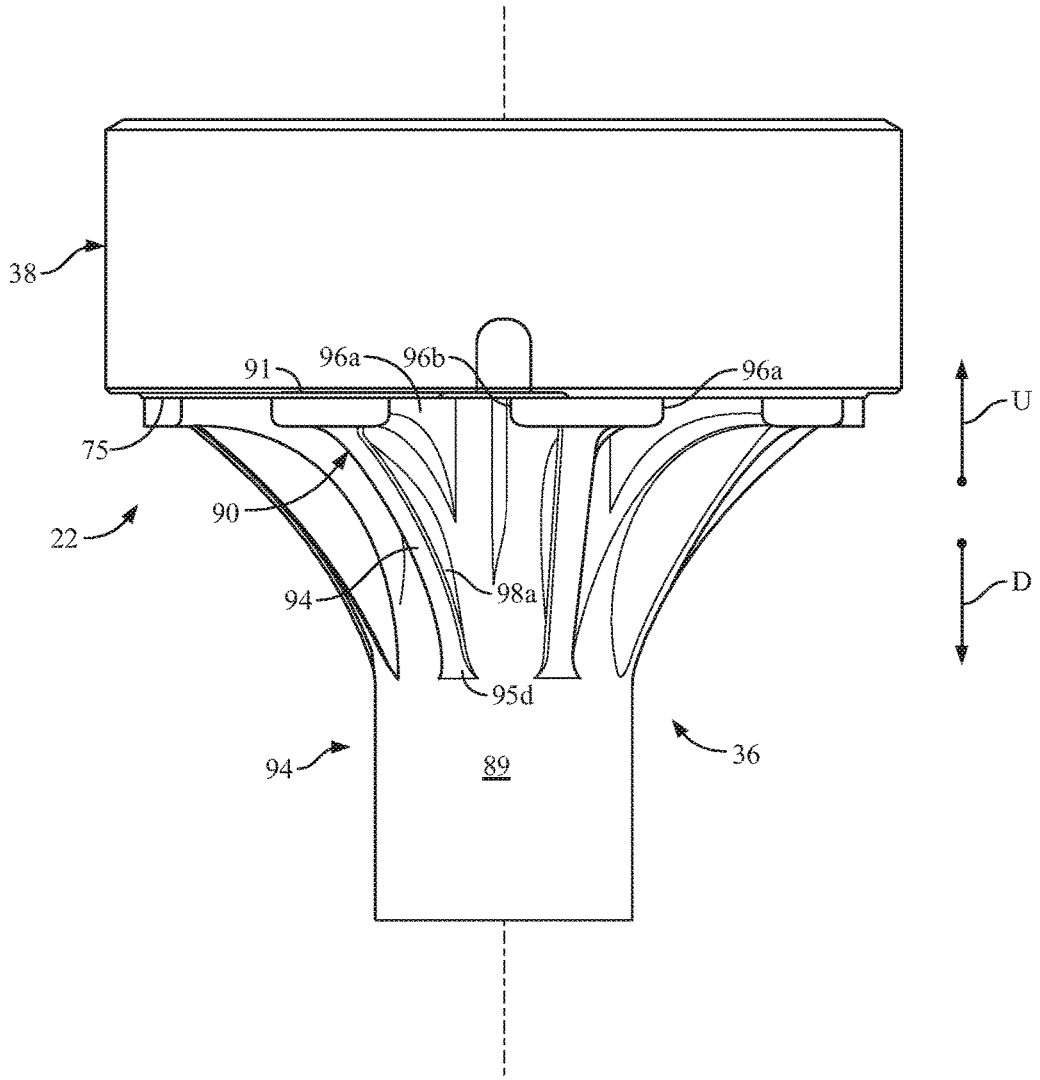
FIG. 15 is a side view of the rotor and stator arranged as if disposed in the drill string as shown in FIGS. 3-6.

The pulser assembly 22 includes the stator 38 and rotor 36 disposed downhole and adjacent to the stator 38 and will be described next. FIGS. 9-11 illustrates a stator 38 in accordance with an embodiment of the present disclosure. FIGS. 12-14 illustrate the rotor 36 while FIGS. 15-19 illustrate the pulser assembly 22, which includes the stator 38 and rotor 36.

Turning to FIGS. 9-11, the stator 38 includes a stator body 70 that includes an uphole end 72, a downhole end 74 spaced from the uphole end 72 in the downhole direction D along a central axis 71, and at least one passage 76 that extends through the stator body 70 in the downhole direction D. The stator body 70 includes a hub 79*a* disposed along the central axis 71 and one or more vanes 79*b* that extend from the hub 79*a* to an outer radial rim 77*a*. The hub 79*a* can include a downhole end 81*d* and an uphole end 81*u* (FIG. 11). The vanes 79*b* at least partially define each respective passage 76. In addition, the stator body 70 also defines an uphole surface 73 disposed at the uphole end 72, a downhole surface 75 disposed at the downhole end 74, and an outer radial surface 77*b* spaced from the central axis 71 along the radial direction R. The radial surface 77*b* extends from the uphole surface 73 to the downhole surface 75. Each passage 76 extends from an uphole opening 82*u* aligned with uphole surface 73 to a downhole opening 82*d* aligned with the downhole surface 75. Only one passage 76 will be described below for ease of illustration.

Continuing with FIGS. 9-11, the cross-sectional shape of the passage 76 can vary along the downhole direction D as needed to control the fluid dynamics of the drilling fluid through and out of the stator 38. In accordance with the illustrated embodiment, the passage 76 constricts as it extends toward the downhole end 74 of the stator 38. The stator body 70 defines a plurality of passage walls that extend from the uphole surface 73 to the downhole surface 75 so as to define the passage 76. The plurality of passage walls can include first and second lateral passage walls 80*a* and 80*b* that extend along the radial direction R and opposed outer and inner passage walls 80*c* and 80*d* that are spaced apart with respect to each other along the radial direction R. The passage walls 80*a*-80*d* are sometimes referred to as passage sides and are defined at least partially by the vanes 79*b*. At least a portion, such as one, two, or up to all of the passage walls 80*a* through 80*d* are inclined or curved so that the passage 76 constricts along the downhole direction D. For instance, one or both of the lateral passage walls 80*a* and 80*b* are inclined with respect to the central axis 71. While the passage walls are illustrated as having an incline with respect to the central axis 71, the passage walls could also curve with respect to the central axis 71 along the longitudinal direction L. Accordingly, the size and/or shape of the uphole opening 82*u* can be different from the size and/or shape of the downhole opening 82*d*.

Continuing with FIGS. 9-11, the uphole opening 82*u* has a first or uphole cross-sectional shape that is perpendicular the central axis 71 and is aligned with the uphole surface 73. The downhole opening 82*d* has a second or downhole cross-sectional shape that is perpendicular to the central axis 71 and is aligned with the downhole surface 75. The first cross-sectional shape defines an area that is larger than an area of the second cross-sectional shape. While the passages are shown having a constricting cross-sectional shape, the passages can have a cross-sectional shape that does not vary significantly between the upstream side and downstream side, similar to the passages of the stator illustrated in U.S. Pat. No. 7,327,634 to Perry et al, incorporated herein by reference.

The stator 38 includes at least one passage 76, preferably a plurality of passages 76. In accordance with the illustrated embodiment, the stator 38 includes eight passages 76 referred to in the art as an 8-port design. It should be appreciated that the stator 38 can include more or less than eight passages 76. For instance, the stator 38 can include four passages, referred to in the art as a 4-port design, or even fewer than four passages.

Turning now to FIGS. 12-14, the rotor 36 includes a rotor body 88 having a central hub 89 and at least one blade (or a plurality of blades 90) that extend outwardly in the radial direction R. The number of blades 90 can correspond to the number of passages in the stator 38. The rotor 36 is configured to rotate relative to the stator 38 to generate pressure pulses as described herein.

Continuing with FIGS. 12-14, each blade 90 includes a base 92 that extends from the central hub 89 in the radial direction R, and a rib 94 that extends from the base 92 along the longitudinal direction L. The base 92 has an inner end 93*i* disposed on the central hub 89 and an outer end 93*o* spaced from the inner end 93*i* in along a radial axis 101 that is aligned with the radial direction R. The radial axis 101 and the central axis 71 intersect and are perpendicular to each other. The base 92 also defines a first lateral side 96*a*, a second lateral side 96*b* opposed to the first lateral side 96*a*, a downhole face portion 97 that extends between the first and second lateral sides 96*a* and 96*b* toward the rib 94, and an upstream surface 91 that is opposite the downhole face portion 97. The upstream surface 91 faces downhole surface 75 of stator 38. As illustrated, the rib 94 projects from the face portion 97. As can be seen in FIG. 13, the downhole face portion 97 curves as it extends from the inner end 93*i* to the outer end 93*o* of the base 92.

Continuing with FIGS. 12-14, and in accordance with the illustrated embodiment, the rib 94 curves as it extends from the base 92 to the central hub 89 with respect to a central axis 71 that is aligned with the longitudinal direction L. The rib 94 has a first or uphole end 95*u* disposed on toward the outer end 93*o* of the base 92, a second or downhole end 95*d* disposed on the central hub 89, a first lateral side 98*a*, and a second lateral side 98 opposed to the first lateral side 96*a*. The rib downhole end 95*d* is offset with respect to base inner end 93*i* along the central hub 89. However, the uphole end 95*u* of the rib 94 is spaced approximately equidistant between the lateral sides 96*a* and 96*b* so that the rib downhole end 95*d* and the outer end 93*o* of the base 92 are aligned along the radial axis 101.

As can be seen FIGS. 12-14, the rib 94 curves with respect to the central axis 71 along the longitudinal direction L and curves slightly with respect to the radial axis 101. The shape of the blades 92 cause an uphole portion of the rib 94 to be axially aligned with a flow path of drilling fluid 18 between adjacent blades 90. When the rotor 36 is not in operation (or one of the described open positions), the fluid 18 exits the passage 76 and flows between the adjacent blade bases 92 along the downhole direction D. The drilling fluid 18 impinges the lateral side 98*a* of the rib 94 applying an opening torque to the rotor 36 in the second rotational direction T2 which biases the rotor into the open position. This opening torque is similar to the opening torque described in U.S. Pat. No. 7,327,634 to Perry et al., incorporated herein by reference in its entirety. Although, ideally, the flow induced opening torque created by the rotor 36 of the present disclosure is such that the open position is relatively stable, this may not always be achieved. Accordingly, in addition to the creation of the flow induced opening torque, the rotor 36 may also be mechanically biased toward the minimum obstruction orientation. For instance the rotor 36 can be mechanically biased as disclosed in U.S. Pat. No. 7,327,634.

Turning now to FIGS. 15-19, pulser assembly 22 is arranged so that the downhole surface 74 of the stator 38 faces the upstream surface 91 of the rotor 36. As shown in FIGS. 16-19, the rotor 36 rotatable into different position to selective permit or obstruct the flow of drilling fluid through the stator so as to generate the pressure pulses.

Figure 16:
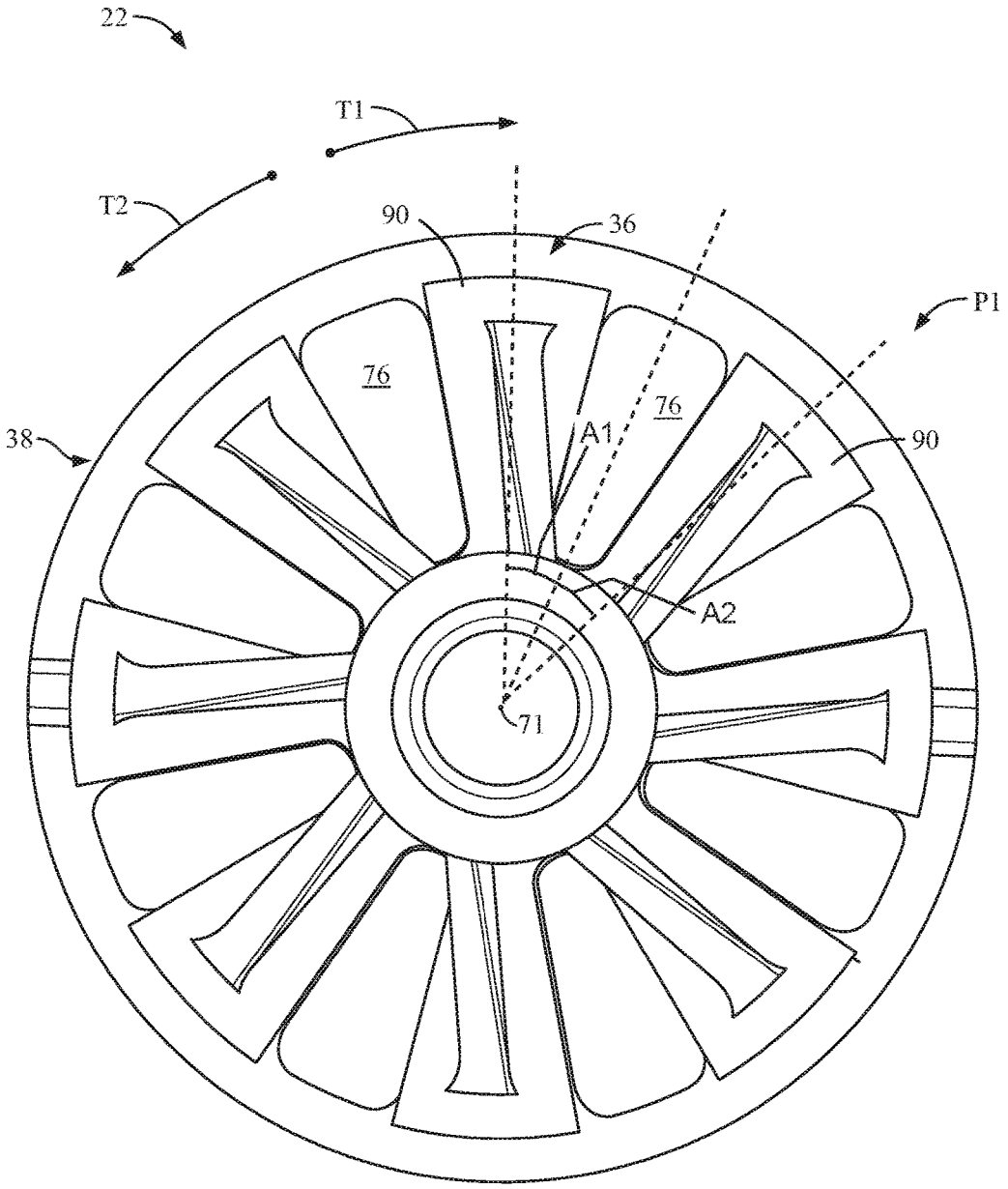
FIG. 16 is a bottom view of the rotor and stator illustrating the rotor in a first open position.
Figure 17:
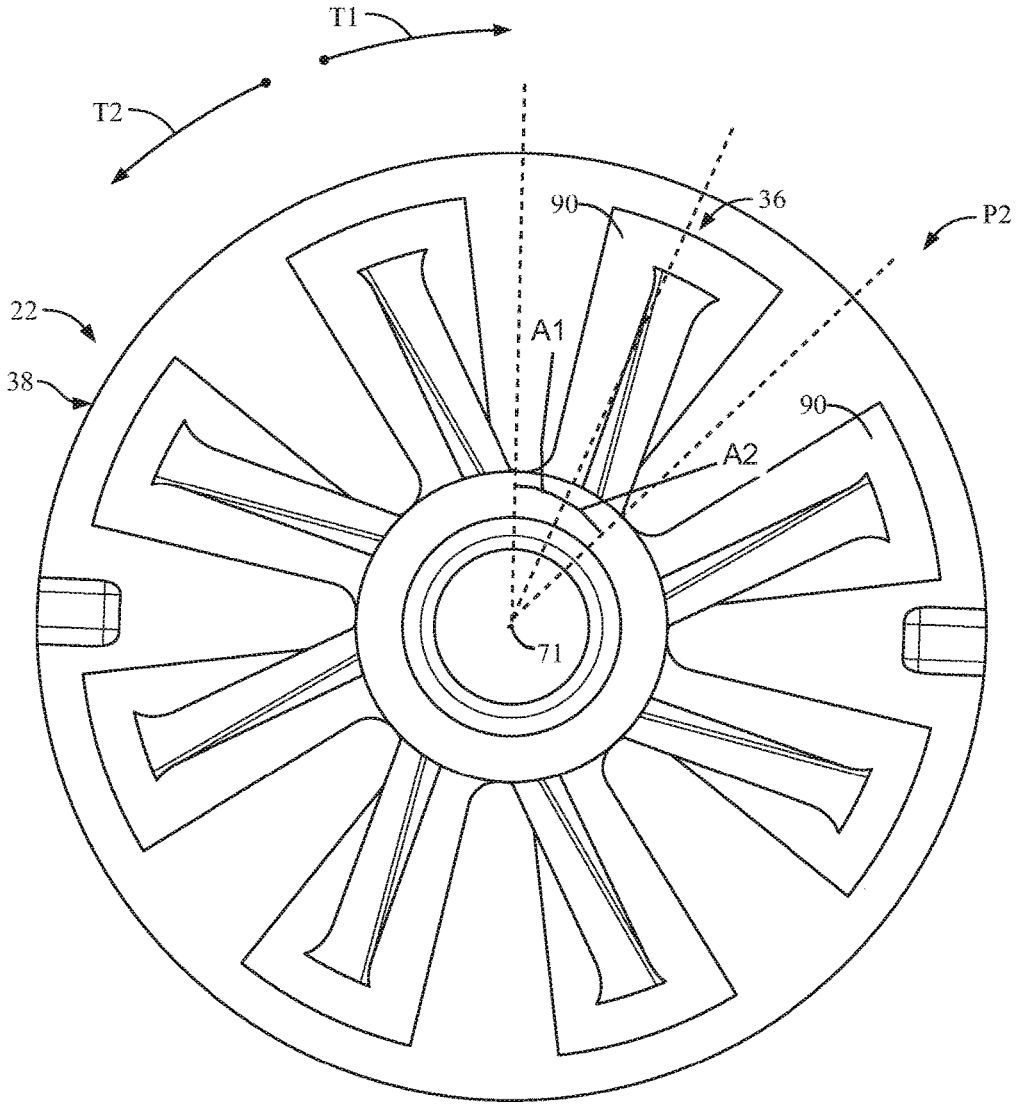
FIG. 17 is a bottom view of the rotor and stator shown in FIG. 16, illustrating the rotor transitioned into a second closed position.

The motor assembly 35 drive rotation of the rotor 36 through the rotation cycle. As shown in FIGS. 16-19. The rotor 36 can rotate in a first direction T1 from a first position P1 (or first open position P1), as shown in FIG. 16, into a second position P2 (or closed position), as shown in FIG. 17. In the first position P1, the blades 90 are rotationally offset such that each blade is between two adjacent passages 76. The rotor 36 permits drilling fluid 18 to pass through the pulser assembly 22 when the rotor is in the first position P1. In the second position P2, the blades 90 obstruct (partially or completely) the passages 76 such that drilling fluid 18 is obstructed from passing through the pulser assembly 22.

As best shown in FIG. 16 and FIG. 17, it should be appreciated that the rotor 36 rotates in the first rotational direction T1 from the first position P1 to the second position P2 by a first angular amount A1. The angular amount A1 is the angle defined by two lines (not numbered) that intersect the central axis 71. The two lines represent the location of the blade 90 in the respective first, second, or third positions. In one example the first angular amount A1 is between about 15 degrees to about 50 degrees. The rotational difference between first position P1 and the second position P2, i.e. the angular amount A1, and between the second position P2 and the third position P3, i.e. the angular amount A2 (discussed below), is based, in part, on the number of passages 76 and the number of blades 90. For example, the angular amount A1 is determined by dividing 180 degrees by the number of blades in the rotor (or number of passage in the stator). For a pulser with a rotor having eight blades and a stator with eight passages, the angular amount A1 is about 22.5 degrees. For a pulser with a rotor having four blades and a stator with four passages, the angular amount A1 is about 45 degrees. While a four blade/four passage pulser and an eight blade/eight passage pulser is described herein, other pulser configurations can be used, which would alter the angular amounts.

Figure 18:
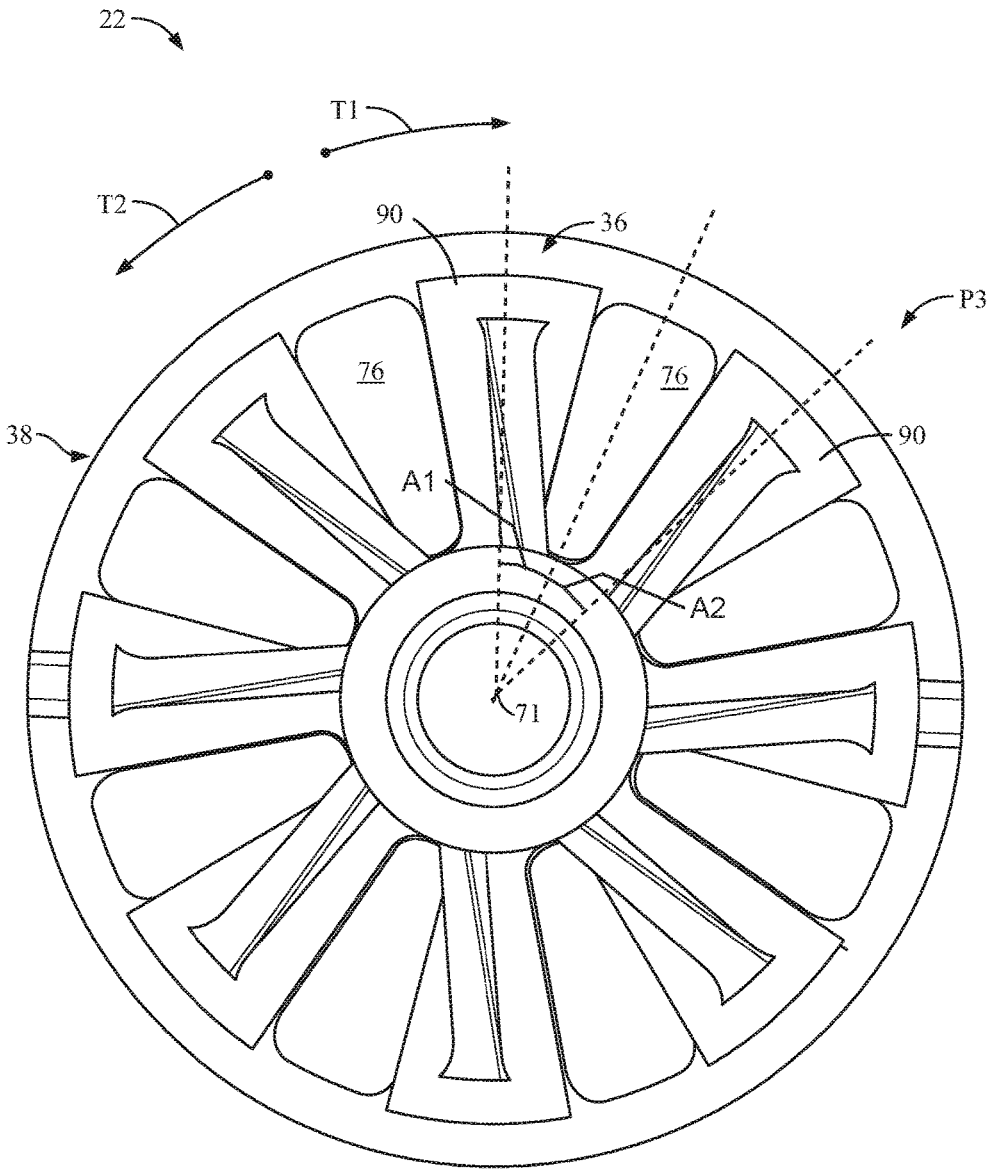
FIG. 18 is a bottom view of the rotor and stator shown in FIG. 17, illustrating the rotor transitioned into a third open position.
Figure 19:
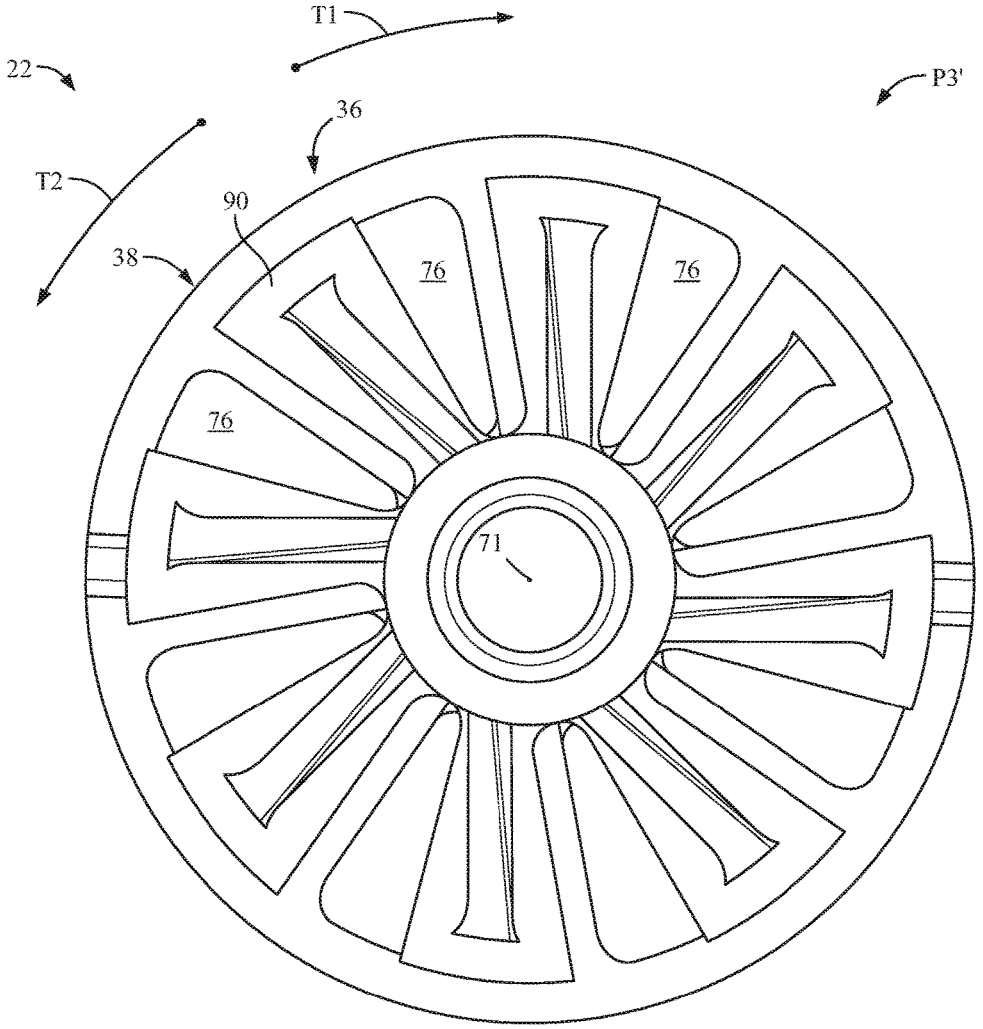
FIG. 19 is a bottom view of the rotor and stator shown in FIG. 17, illustrating the rotor transitioned into an alternative third position.

As explained below, the rotor 36 is stationary in the second position P2 for a period of time before continuing to rotate in the first direction T1 into a third position P3 (or second open position), as shown in FIG. 18, or into third position P3', as shown in FIG. 19. In the third position P3, the blades 90 are rotationally offset such that each blade is between two adjacent passages 76. The rotor 36 permits drilling fluid 18 to pass through the pulser assembly 22 when the rotor is in the third position P3.

Alternatively, as shown in FIG. 19, in the third position P3' the blades 90 are rotationally offset such that the blades 90 partially obstruct the passages 76, such that drilling fluid 18 is partially obstructed from passing through the pulser assembly 22.

As illustrated in FIGS. 17-19, the rotor rotates from the second position P2 to the third position P3, P3' by a second angular amount A2 in the first rotational direction T1. The second angular amount A2 can range between about 10 degrees and 50 degrees. Typically, the first and second angular amounts are substantially equal. For example, for eight blades, the first angular amount may be about 22.5 degrees and the second angular amount may be about 22.5 degrees.

The rotor 36 can be rotated in the second direction T2 back to second position P2 and held in place in the second position P2 for a period of time. Then, the rotor 36 is further rotated in the second direction T2 to the first position P1, where the blades 90 are rotationally offset from the passages 76 and drilling fluid can pass through the pulser assembly 22. Alternatively, the rotor 36 can be rotated in the second direction T2 from the second position P2 to a fourth position P4 that is rotationally between first position P1 and second position P2.

Another embodiment of the present disclosure includes a method 300 for transmitting information from a downhole location in a well bore toward the surface. The MWD tool 20 and/or pulser assembly 22 is typically added to the drill string 6 when the bottom hole assembly is "made up" at the rig site. In accordance with the illustrated embodiment, method 300 includes a step 304 of initiating operation of the pulser 12 at the surface. Pulser initiation step 304 may include coupling the drive shaft 34 to the motor 32. This coupling may occur manually or electronically via an instruction from a linked computing device. Initiation step 304 may further include defining the first position P1 of the rotor 36. For instance, in response to connecting the power source to the motor assembly 35, the drive shaft 34 rotates until it contacts a mechanical stop, establishing an idle state for the pulser 12. In the idle state, the rotor may be in the first open position P1 as shown in FIG. 16. A sensor determines the angular position of the shaft 34 and the rotor 36 when the shaft 34 abuts the mechanical stop. The sensor data is used to define the first open position P1 and that data is stored in the memory portion of the controller.

Next, the drill string and pulser 12 are lowered into the borehole and drilling is initiated. In step 312, drilling fluid is directed trough an elongate passage of the drill string in a downhole direction toward the pulser 12. During step 312, the controller can optionally determine if the position of the rotor needs to be corrected. If needed, the controller automatically corrects the rotor position. For instance, if the rotor moves from the first open position P1 without an instruction from the controller to do so, e.g. as a result of handling or vibration, the controller can cause the drive shaft 34 to rotate in the desired direction to correct the position of the rotor.

In step 318, sensors 8 located in the MWD tool (or any other tool) obtain drilling information concerning a parameter of interest. The MWD tool can also pack the drilling information into a digital signal via the encoder as described above. In step 324, the digital signal containing the drilling information is transmitted from the tool 20 to the pulser 12, in particular, to the controller.

In step 328, the controller, in response to receiving the digital signal from the MWD tool 20, determines one or more signal characteristics. In one example, the controller determines a wavelength of the signal. The amplitude, frequency, and other features can be determined. In step 328, the controller further determines a period of time that corresponds to the wavelength of the signal to be transmitted to the surface via the pulser. The period of time is used to control the duration that the rotor 36 is maintained in the second closed position (as shown in FIG. 17) during each rotation cycle. For example, the period of time can be from about 0 seconds to about 1.25 seconds. The period of time that the rotor 36 is maintained in the second closed position can be programmed into the controller 26 prior to lowering the drill string into the borehole. Alternatively, this period of time can be changed in response to drilling conditions obtained by the sensors 8. For example, changes to the period of time the rotor 36 is maintained in the second closed position can be transmitted to the downhole dynamic pressure sensor 28 through pressure pulses 116, which can be generated by the surface pulser 224. In one example, the time period is determined by the well conditions, such as depth and flow rate. Increasing the time period will result in stronger pulses at the surface, necessary for successful decoding in a deep well.

Figure 20:
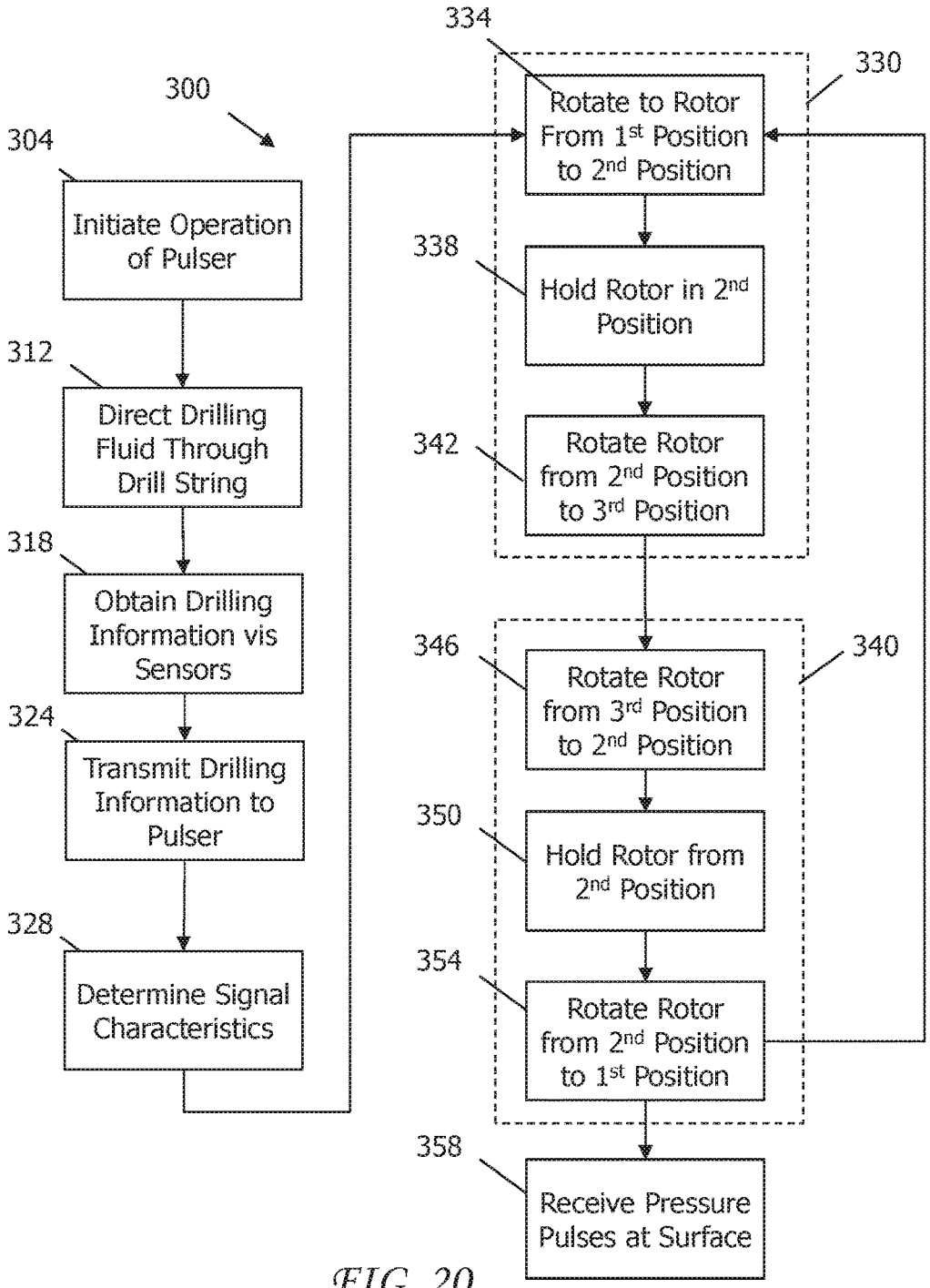
FIG. 20 is a process flow diagram illustrating a method for transmitting information with the rotary pulser according to an embodiment of the present disclosure.

In steps 342 through step 354, the controller encodes the data signal into a series of pressure pulses generated by the repeated rotation of the rotor 36 through the first rotation 330 cycle and the second rotation cycle 340. The first rotation cycle 330 is illustrated in the dashed line box in FIG. 20 that contains step 334 through 342. The second rotation cycle 340 is illustrated in the dashed line box in FIG. 20 that contains step 346 through step 354. After completing the first rotation cycle 330, the second rotation cycle 340 is initiated.

In step 334, the controller initiates the first rotation cycle 330. In step 334, the controller causes rotation of the rotor in a first rotational direction from a first position P1 relative to the stator into the second position P2 (see FIGS. 16 and 17). In the first position P1, the blades 90 are offset with respect to the passages 76 so to permit the drilling fluid to flow through passages 76. In the second position P2, the blades 90 are aligned with the passages 76 of the stator 38 along the axial direction L to obstruct the flow of drilling fluid. Step 334 also includes rotating the rotor in the first rotational direction from the first position to the second position by a first angular amount A1, as best shown in FIG. 16. The angular amount A1 is the angle defined by two lines (not numbered) that intersect the central axis 71. The two lines represent the location of the blade 90 in the respective first, second, or third positions. In one example the first angular amount A1 is between about 15 degrees to about 50 degrees.

In step 338, the rotor is maintained in the second position for a first period of time. Step 338 also represents an intermediate phase of the first rotation cycle 330 where the rotor is stopped to obstruct the drilling fluid. The duration of time the rotor is in the second position determines the wavelength of the pressure pulse transmitted through the drilling fluid. In one example, the period of time may be between about 0.01 seconds (or normally more than 0 seconds) and about 2.0 seconds. In one example, the period of time is up to about 1.25 seconds. In another example, the period of time is greater than 2.0 seconds.

In step 342, the rotor is further rotated in the first rotational direction from the second position P2 to the third position P3 or P3'. In the third position P3, the blades 90 are completely offset with respect to the passages 76, permitting drilling fluid to flow un-obstructed through the passages 76. In the third position P3' the blades 90 partially offset with respect to the passages 76, such that drilling fluid 18 is partially obstructed from passing through the pulser assembly 22. Step 342 also includes rotating the rotor from the second position to the third position P3, P3' by a second angular amount A2 in the first rotational direction. The second angular amount range between about 10 degrees and 50 degrees. Typically, the first and second angular amounts are substantially equal.

In step 346, the controller initiates the second rotation cycle 340. The second rotation cycle 340 includes steps 346 through step 358. The second rotation cycle 340 includes rotating 346 the rotor 36 in the second rotational direction T2 from the third position P3 (FIG. 18) or P3' (FIG. 19) to the second position P2 (as shown in FIG. 17). Step 346 includes rotating the rotor from the third position P3, P3' to the second position P2 by the second angular amount in the second rotational direction. In step 350, the controller stops, or maintains, the rotor 36 in the second position for a second period of time. In one example, the second period of time may be up to about 1.25 seconds. It should be appreciated that the first period of time in step 338 and the second period of time in step 346 can have the same duration. Alternatively, the first period of time in step 338 and the second period of time in step 346 can have different duration. For example, one may be longer than the other.

In step 354, the rotor is rotated in the second rotational direction from the second position P2 to the first position P1 (see FIG. 16). Step 354 includes rotating the rotor from the second position to the first position by the first angular mount in the second rotational direction. Alternatively, in step 354, the rotor is rotated in the second rotational direction from the second position P2 into a fourth position P4 that is between the first position P1 and the second position P2. Step 354 completes the second rotation cycle 330.

From step 354, the method can proceed back to step 334 to start the first rotation cycle again. The first and second rotation cycles can repeat as many times as needed to generate the required pulses. In step 358, the pressure pulses are detected at the surface by a surface receiver and the drilling information is extracted from the pressure pulse signal.

The method 300 continues, repeating the first rotation cycle and the second rotation cycle to generate a series of pressure pulses in the drilling fluid. Advantageously, the motor assembly 35 consumes less than or equal to about 6.0 Joules of power to rotate the rotor through the each rotation cycle when the period of time the rotor 36 stops in the second position P2 is greater than 0 seconds. When, however, there is no pause during a rotation cycle, the motor assembly will consume less than or equal to 3.0 Joules of power. Accordingly, the pulser as described herein consumes less than or equal to about 6.0 Joules of power to generate a single pressure pulse.

During each rotation cycle that generates a pressure pulse, the rotor is stopped only once in the third position. As discussed above, in some cases the rotor pauses in the second position. The resultant pressure pulse is therefore generated with a motor accelerating and decelerating the rotor only one time. For conventional pulsers, two distinct instances of acceleration and deceleration are required to generate an equivalent pressure pulse. Although traveling a longer distance to rotate the rotor to complete a single pressure pulse, because only one acceleration and one deceleration of the motor is used in present pulser, much less power is consumed. In at least one example, the pulser as described herein uses about more than 50% less power, for example between 60-70% less power than conventional rotary pulsers over similar operating times. Because less power is used per pressure pulse, the pulsers as described herein can operate for longer periods of time during drilling before the power source needs to be replaced. This has two important benefits. First, this decreases battery costs because few batteries are required to operate the pulser over its useful life. Second, there are fewer instances where drilling must be stopped and the pulser pulled out of the well bore to replace or recharge the battery. This, in turn, minimizes downtime and maximizes drilling time, reducing operating costs for the drill operator.

While reducing power consumption, the pulser also can generate pressure pulses at relatively higher speeds, increasing the data rate. For instance, the rotor completes one rotation cycle to generate a single pressure pulse in less time than is required for conventional pulsers to generate a similar pressure pulse. In addition, by varying the speed of the motor, and controlling the time the rotor is in the second position, it is possible to better control pulse widths (or pulse wavelength). Shorter pulse wavelengths result in higher data rates. In one example, data rates as high as 5 bits per second have been observed. Accordingly, the pulser assembly 22 described above is configured to generate high data output pressure pulses and consume less power while generating each pressure pulse.

In another embodiment, the pulser produces a first pressure pulse by continuously rotating the rotor from the first position P1 to the third position P3 in the first rotational direction T1. In this embodiment, the rotor passes through the second position P2 without stopping for any period of time. In this embodiment, the motor assembly 35 consumes less than or equal to about 3.0 Joules of power to rotate the rotor through each rotation cycle. This embodiment also allows for the production of pulses with a pulse width of less than or equal to 0.2 seconds. As such, energy consumption of the motor assembly is reduced while pulse width is also decreased, which increases the data rate. As described above, in the third position P3, P3' the rotor 36 is positioned relative to the stator 38 such that the drilling fluid 18 flows through the stator 38 (see e.g., FIGS. 18 and 19).

Additionally, in this embodiment, a second pressure pulse can be produced by continuously rotating the rotor 36 from the third position P3, P3' to the first position P1 in the second rotational direction T2. Again, the rotor passes through the second position without stopping for any period of time. Alternatively, a second pressure pulse can be produced by continuously rotating the rotor 36 from the third position P3, P3' to the fourth position P4. As described above, the fourth position P4 is rotationally between the first position P1 and the second position P2.

The present disclosure is described herein using a limited number of embodiments, these specific embodiments are not intended to limit the scope of the disclosure as otherwise described and claimed herein. Modification and variations from the described embodiments exist. More specifically, the following examples are given as a specific illustration of embodiments of the claimed disclosure. It should be understood that the invention is not limited to the specific details set forth in the examples.

What is claimed:

1. A rotary pulser configured to be positioned along a drill string through which a drilling fluid flows, the rotary pulser comprising:

a housing configured to be supported in an internal passage of the drill string;

a stator supported by the housing, the stator including an uphole end, a downhole end spaced from the uphole end, and at least one passage that extends from the uphole end to the downhole end;

a rotor adjacent to the downhole end of the stator and rotatable to selectively obstruct the at least one passage;

a motor assembly coupled to the rotor, wherein the motor assembly is operable to rotate the rotor relative to the stator through a rotation cycle to generate a pressure pulse such that a plurality of rotation cycles generates a plurality of pressure pulses, respectively; and a controller configured to:

1) receive a signal that includes information, and in response to receiving the signal, cause the motor assembly to rotate the rotor in a first rotational direction through the rotation cycle at a rotational speed so as to:

a) rotate the rotor from a first position, where the rotor does not obstruct the at least one passage, into a second position, where the rotor obstructs the at least one passage; and b) further rotate the rotor in the first rotational direction from the second position to a third position, where the rotor does not obstruct the at least one passage, and the third position is different from the first position and the second position, 2) cause the motor assembly to vary the rotational speed of the rotor between the first position to the third position within the rotation cycle so as to vary portions of the pressure pulse generated by rotation of the rotor through the rotation cycle when drilling fluid is flowing through the drill string.

2. The rotary pulser of claim 1, wherein the controller is configured to cause the motor assembly to hold the rotor in the second position for a period of time.

3. The rotary pulser of claim 1, wherein the at least one passage is not obstructed by the rotor in the third position.

4. The rotary pulser of claim 1, wherein the at least one passage is at least partially obstructed by the rotor in the third position.

5. The rotary pulser of claim 1, wherein the rotation cycle is a first rotation cycle, and the pressure pulse is a first pressure pulse, wherein the controller is configured to cause the motor assembly to rotate the rotor in a second rotational direction that is opposite to the first rotational direction through a second rotation cycle so as to:

a) rotate the rotor from the third position to the second position in the second rotational direction; and b) rotate the rotor from the second position into the first position in the second rotational direction, whereby rotation of the rotor through the second rotation cycle when the drilling fluid is flowing through the drill string generates a second pressure pulse.

6. The rotary pulser of claim 5, wherein the controller is configured to cause the rotor to repeatedly rotate through the first rotation cycle and the second rotation cycle so as to generate a series of the first and second pressure pulses, wherein the series of the first and second pressure pulses have encoded therein the information.

7. The rotary pulser of claim 5, wherein the controller is configured to cause the motor assembly to hold the rotor in the second position for a second period of time.

8. The rotary pulser of claim 1, wherein the rotation cycle is a first rotation cycle, and the pressure pulse is a first pressure pulse, wherein the controller is configured to cause the motor assembly to rotate the rotor in a second rotational direction that is opposite to the first rotational direction through a second rotation cycle so as to:

a) rotate the rotor from the third position to the second position in the second rotational direction; and b) rotate the rotor from the second position into a fourth position that is between the first position and the second position in the second rotational direction, whereby rotation of the rotor through the second rotation cycle when the drilling fluid is flowing through the drill string generates a second pressure pulse in the drilling fluid.

9. The rotary pulser of claim 8, wherein the controller is configured to cause the motor assembly to hold the rotor in the second position for a second period of time.

10. The rotary pulser of claim 8, wherein the controller is configured to cause the rotor to repeatedly rotate through the first rotation cycle and the second rotation cycle so as to generate a series of the first pressure pulse and the second pressure pulse, wherein the series of the first pressure pulse and the second pressure pulse have encoded therein the information.

11. The rotary pulser of claim 1, wherein the rotor is spaced relative to the stator along an axial direction, and the rotor includes at least one blade that extends outwardly in a radial direction that is perpendicular to the axial direction, wherein the at least one blade is a) offset with respect to the at least one passage when the rotor is in the first position and the third position, and b) is aligned with the at least one passage along the axial direction when the rotor is in the second position.

12. The rotary pulser of claim 11, wherein the at least one blade is four blades and the at least one passage is four passages.

13. The rotary pulser of claim 11, wherein the at least one blade is eight blades and the at least one passage is eight passages.

14. The rotary pulser of claim 2, wherein the period of time is up to about 2.0 seconds.

15. The rotary pulser of claim 1, further comprising a power source that powers the motor assembly, wherein the motor assembly pulls no greater than about 6.0 Joules from the power source to rotate the rotor through the rotation cycle to generate the pressure pulse.

16. The rotary pulser of claim 1, wherein the controller is further configured to cause the motor assembly to rotate the rotor at a first rotational speed from the first position to the second position, and at a second rotational speed from the second position to the third position, wherein the second rotational rotation speed is different from the first rotational speed.

17. The rotary pulser of claim 1, wherein angular displacement of the rotor from the first position to the third position is between 20 degrees and 100 degrees.

18. A rotary pulser configured to be positioned along a drill string having an internal passage, the rotary pulser comprising:

a housing configured to be supported in the internal passage of the drill string;

a stator supported by the housing, the stator including an uphole end, a downhole end spaced from the uphold end, and at least one passage that extends from the uphole end to the downhole end;

a rotor adjacent to the downhole end of the stator;

a motor assembly coupled to the rotor, wherein the motor assembly is operable to rotate the rotor relative to the stator so as to selectively obstruct the at least one passage;

a power source configured to supply energy to the motor assembly; and a controller configured to receive a signal that includes information, and in response to receiving the signal, cause the motor assembly to rotate the rotor in a first rotational direction through a single rotation cycle to generate a pressure pulse in a drilling fluid flowing through the internal passage of the drill string, the rotation cycle including: A) rotation of the rotor in the first rotational direction from a first position, where the rotor does not obstruct the at least one passage, into a second position, where the rotor obstructs the at least one passage, and B) further rotation of the rotor in the first rotational direction from the second position into a third position, where the rotor does not obstruct the at least one passage, and the third position is different from the first position and the second position, wherein the motor assembly pulls no greater than about 6.0 Joules from the power source when rotating the rotor through the rotation cycle in the first rotational direction between the first position and the third position to generate the pressure pulse, wherein an angular rotation of the rotor from the first position to the third position is between 20 degrees and 100 degrees.

19. The rotary pulser of claim 18, wherein the rotation cycle is a first rotation cycle, the pressure pulse is a first pressure pulse, and the first rotation cycle includes a first intermediate phase, wherein the controller is configured to cause the motor assembly to rotate the rotor in a second rotational direction through a second rotation cycle to generate a second pressure pulse in the drilling fluid, and the second rotation cycle includes a second intermediate phase where the rotor obstructs a flow of the drilling fluid flowing through the at least one passage.

20. The rotary pulser of claim 19, wherein the controller is configured to cause the rotor to repeatedly rotate through the first rotation cycle and the second rotation cycle so as to generate a series of the first and second pressure pulses when the drilling fluid is flowing through the drill string and the housing is supported in the internal passage of the drill string.

21. The rotary pulser of claim 19, wherein the first rotation cycle includes:

a) rotation of the rotor from a first position, where the rotor does not obstruct the at least one passage, into a second position, where the rotor obstructs the at least one passage;

b) the first intermediate phase where rotation of the rotor is maintained in the second position for a first period of time; and c) rotation of the rotor from the second position to a third position in the first rotational direction.

22. The rotary pulser of claim 21, wherein the at least one passage is not obstructed by the rotor in the third position.

23. The rotary pulser of claim 21, wherein the at least one passage is at least partially obstructed by the rotor in the third position.

24. The rotary pulser of claim 21, wherein the second rotation cycle includes:

a) rotation of the rotor from the third position to the second position;

b) the second intermediate phase where rotation of the rotor is maintained in the second position for a second period of time; and c) rotation of the rotor from the second position to the first position.

25. The rotary pulser of claim 21, wherein the second rotation cycle includes:

a) rotation of the rotor from the third position to the second position;

b) the second intermediate phase where rotation of the rotor is maintained in the second position for a second period of time; and c) rotation of the rotor from the second position into a fourth position that is between the first position and the second position.

26. The rotary pulser of claim 21, wherein the rotor is spaced relative to the stator along an axial direction, and the rotor includes at least one blade that extends outwardly in a radial direction that is perpendicular to the axial direction, wherein the at least one blade is a) offset with respect to the at least one passage when the rotor is in the first position and the third position, and b) is aligned with the at least one passage along the axial direction when the rotor is in the second position.

27. The rotary pulser of claim 26, wherein the at least one passage is eight passages, and the at least one blade includes eight blades.

28. The rotary pulser of claim 18, wherein a rotational speed of the rotor varies within the single rotation cycle to generate the pressure pulse.

29. A method of transmitting information from a downhole location along a drill string forming a well bore in an earthen formation toward a surface of the earthen formation, the method comprising:

directing a drilling fluid through an elongated passage of the drill string in a downhole direction toward a rotary pulser mounted to the drill string in the elongated passage, the rotary pulser including a stator that includes at least one passage, and a rotor adjacent to a downhole end of the stator, the rotor including at least one blade;

rotating the rotor in a first rotational direction at a first rotational speed relative to the stator from a first position, where the rotor permits the drilling fluid to pass through the at least one passage, to a second position, where the rotor obstructs the drilling fluid through the at least one passage; and further rotating the rotor in the first rotational direction at a second rotational speed that is different than the first rotational speed from the second position to a third position, where the rotor permits the drilling fluid to pass through the at least one passage, and the third position is different from the first position and the second position, wherein rotation of the rotor in the first rotational direction from the first position to the third position to defines a rotation cycle that generates a pressure pulse in the drilling fluid, wherein a plurality of rotation cycles generates a plurality of pressure pulses that contains the information.

30. The method of claim 29, further comprising:

obtaining the information from a sensor located in a downhole portion of the drill string.

31. The method of claim 29, further comprising:

maintaining the rotor in the second position for a period of time.

32. The method of claim 31, wherein the period of time is a first period of time, and the method further comprises:

rotating the rotor in a second rotational direction from the third position to the second position, wherein the second rotational direction is opposite to the first rotational direction;

maintaining the rotor in the second position for a second period of time; and rotating the rotor in the second rotational direction from the second position to the first position, wherein repeated rotation of the rotor between the first position and the third position generates a series of the pressure pulses that contain the information.

33. The method of claim 31, wherein the period of time is a first period of time, and the method further comprises:

rotating the rotor in a second rotational direction from the third position to the second position, wherein the second rotational direction is opposite to the first rotational direction;

maintaining the rotor in the second position for a second period of time; and rotating the rotor in the second rotational direction from the second position into a fourth position that is between the first position and the second position, wherein repeated rotation of the rotor generates a series of the pressure pulses that contain the information.

34. The method of claim 29, further comprising:

obtaining drilling information via a sensor disposed along the drill string;

transmitting a signal containing the information to a controller;

determining, via the controller, a wavelength of the signal; and determining, via the controller, a period of time that corresponds to the wavelength of the signal.

35. The method of claim 32, wherein rotating the rotor from the first position to the second position includes rotating the rotor a first angular amount that is between about 10 degrees and about 50 degrees.

36. The method of claim 35, wherein rotating the rotor from the second position to the third position in the first rotational direction includes rotating the rotor a second angular amount that is between about 10 degrees and about 50 degrees.

37. The method of claim 36, wherein rotating the rotor from the third position to the second position in the second rotational direction includes rotating the rotor the second angular amount.

38. The method of claim 37, wherein rotating the rotor from the second position to the first position includes rotating the rotor the first angular amount.

39. The method of claim 36, wherein the at least one passage is four passages, and the at least one blade is four blades, wherein the first angular amount is about 45 degrees, and the second angular amount is about 45 degrees.

40. The method of claim 36, wherein the at least one passage is eight passages, and the at least one blade includes eight blades, wherein the first angular amount is about 22.5 degrees, and the second angular amount is about 22.5 degrees.

41. The method of claim 29, wherein no more than about 6.0 Joules is required to rotate the rotor in order to generate the pressure pulse.

42. The method of claim 29, wherein the rotor partially obstructs the drilling fluid through the at least one passage in the third position.

43. The method of claim 29, wherein the rotor does not obstruct the drilling fluid through the at least one passage in the third position.

* * * * *